United States Patent [19]

Langenbeck

[11] Patent Number: 4,704,841

[45] Date of Patent: Nov. 10, 1987

[54] BEVERAGE TRAY PACKING SYSTEM

[76] Inventor: Keith A. Langenbeck, 4005 University Blvd., Dallas, Tex. 75205

[21] Appl. No.: 889,734

[22] Filed: Jul. 28, 1986

[51] Int. Cl.[4] ..... B65B 35/44; B65B 57/12; B65B 39/12; B65B 5/08

[52] U.S. Cl. ..... 53/448; 53/475; 53/58; 53/500; 53/534; 53/542; 53/251

[58] Field of Search ..... 53/534, 58, 251, 55, 53/242, 448, 543, 542, 475, 500, 495, 498

[56] References Cited

U.S. PATENT DOCUMENTS

| | | | |
|---|---|---|---|
| 25,852 | 9/1865 | Nigrelli et al. | 53/251 X |
| 3,354,613 | 11/1967 | Anderson et al. | 53/251 |
| 3,478,491 | 11/1969 | Lattke | 53/534 X |
| 3,599,397 | 8/1971 | Standley et al. | 53/534 X |
| 4,389,832 | 6/1983 | Calvert | 53/534 X |
| 4,391,078 | 7/1983 | Nigrelli | 53/251 |
| 4,578,930 | 4/1986 | Simelunas et al. | 53/251 X |

FOREIGN PATENT DOCUMENTS

| | | | |
|---|---|---|---|
| 1433134 | 4/1976 | United Kingdom | 53/534 |

*Primary Examiner*—Horace M. Culver
*Attorney, Agent, or Firm*—W. Kirk McCord

[57] ABSTRACT

A system and method for packing containers, such as beverage containers, into a transport tray is comprised of a first conveyor track on which the containers are transported and a second conveyor track on which the trays are transported. A portion of the second conveyor track is inclined with respect to the first conveyor track so that the first and second tracks converge at a predetermined location. A packing ramp is pivotally mounted at the downstream end of the first track adjacent to the predetermined location at which the two tracks converge. The packing ramp is moved upwardly to an inclined position when the ramp is in contact with either the leading or the trailing edge of a tray. The containers are packed into the tray in sequence from the leading edge to the trailing edge of the tray while the tray is on the inclined portion of the second track. A plurality of sensors, such as photoeyes, is used in conjunction with a computer to control the operation of the system.

37 Claims, 27 Drawing Figures

BEVERAGE TRAY PACKING SYSTEM

FIELD OF THE INVENTION

The present invention relates generally to tray packing systems and in particular to a system for packing individual beverage containers into a tray for further transport.

BACKGROUND OF THE INVENTION

Beverages, such as soft drinks and beer, and distributed commercially in glass and plastic bottles and in aluminum cans. Single service beverage containers, which typically contain six to twenty-four ounces of the beverage, are usually grouped into individual cases, each usually containing twenty-four individual containers. These cases may be further subdivided into groups of six, eight or twelve individual beverage container packages.

Typically, each case of beverage containers is loaded into a separate tray for transport from the site of a bottling company to the point of sale, such as at a grocery store. Such trays are typically made of wood, corrugated paper or plastic. Many of these trays, corrugated paper types in particular, are usually disposed of after the beverage containers are removed from their trays at their respective points of sale.

DESCRIPTION OF THE PRIOR ART

Automated systems for loading individual beverage containers into respective trays for transportation are known in the art. According to prior practice, such automated systems typically fall into one of the following three categories: (1) tray former loader systems; (2) vertical drop/set packer systems; and (3) ski packer systems. All such systems rely on synchronization between the movement of the individual cans or bottles on a first conveyor track with the movement of the individual trays into which the cans or bottles are to be packed on a second conveyor track.

In tray former loader systems a corrugated paper tray is typically pushed onto the track carrying the beverage containers at right angles with respect to the direction of movement thereof. The leading edge of the tray is folded up to catch the cans on the leading edge and subsequently the side edges and back edge of the tray are folded up to form the container. Tray former loader systems have the advantage of being relatively fast in that they can package approximately 60–80 cases per minute, but have the disadvantage of being relatively complex and costly and the corrugated paper tray is not reusable. The cost of a typical tray former loader system is on the order of $150,000–$250,000.

Vertical drop/set packer systems employ a device for dropping/setting the individual beverage containers vertically downward into a pre-formed transport tray. This type of system has the disadvantage of being relatively slow in that it is only able to process approximately 30–35 cases per minute, but the system can pack individual containers into a wide variety of tray types and designs.

Ski packer systems use a spring-loaded mechanism, which is tripped by the weight of the individual beverage containers. When the mechanism is tripped, 24 individual beverage containers comprising a case are launched down a ramp and into a transport tray. Because of the manner in which the cans are launched into the tray, the vertical depth of the tray must be greater than one-half of the height of the individual beverage containers in order to properly capture the containers within the tray. Ski packer systems can typically process approximately 50–55 cases per minute. Although ski packer systems are useful for loading six-packs into transport trays, they are not well-suited for packing individual beverage containers. Ski packer systems typically use pre-formed, non-reusable corrugated paper trays.

OBJECTS OF THE INVENTION

It is, therefore, the principal object of the present invention to provide an improved system for packing beverage containers into a transport tray.

Another object of the invention is to provide a more reliable and less expensive system for loading beverage containers into a transport tray.

Still another object of the invention is to provide a system for loading beverage containers into a transport tray, which is suitable for loading both pre-packaged containers and individual loose containers.

Yet another object of the invention is to provide a faster and more economical system for packing beverage containers into a transport tray.

A further object of the invention is to provide a system for packing beverage containers into a transport tray without unnecessarily interrupting or slowing the movement of the beverage containers along a primary conveyor track.

SUMMARY OF THE INVENTION

These and other objects are accomplished in accordance with the present invention wherein an improved system and method for packing containers into a transport tray is provided. The system is comprised of first conveyor means for transporting the containers along a first conveyor track; means for dividing the containers into selected groups corresponding to the number of containers to be loaded into each tray; second conveyor means for transporting the trays along a second conveyor track; ramp means pivotally attached to the first track for being moved upwardly to an inclined position with respect to the first track when the ramp means is in engagement with the leading or trailing edge of one of the trays and for being returned to a substantially horizontal position with respect to the first track when the ramp means is not in engagement with the leading or trailing edge of one of the trays; and means for controlling the movement of the containers on the first track and the trays on the second track so that the individual containers in each group are packed into the corresponding tray in succession from the leading edge to the trailing edge of the tray. A portion of the second conveyor track is inclined with respect to the first track so that the first and second tracks converge at a predetermined location. The ramp means is attached to the first track adjacent to the predetermined location and the containers are packed into the tray as the tray is moved along the inclined portion of the second track.

In one embodiment the first track is comprised of a moveable portion and a stationary portion, which is downstream of the moveable portion. The first conveyor means includes first, second and third sprocket-driven chain means arranged to form first, second and third continuous vertical loops. A portion of the first chain means defines the moveable portion of the first track and the second and third chain means each have a plurality of projection members extending therefrom for moving the groups of containers along the stationary portion of the first track. In another embodiment the system further includes fourth and fifth sprocket-driven chain means on which a plurality of elongated dividers are positioned for being interposed between selected containers on the moveable portion of the first track for dividing the containers into discrete groups. In yet another embodiment first drive means is provided for operating the first chain means, second drive means is provided for operating the second conveyor track, third drive means is provided for operating the second and third chain means and fourth drive means is provided for operating the fourth and fifth chain means.

In the preferred embodiment each group of containers is arranged in a substantially rectangular pattern of rows and columns. Each row is oriented laterally across the first track and each column is oriented longitudinally therealong. All of the containers in a particular row are packed substantially simultaneously into the corresponding tray and each row of containers is packed in succession so that the tray is filled in sequence from the leading edge to the trailing edge thereof. A computer implemented control system is used to selectively activate and deactivate the first, second, third and fourth drive means in response to input signals received from a plurality of sensors positioned at selected locations on the first and second tracks. The sensors, which are preferably photoelectric detectors, detect the presence or absence of containers and trays on the respective first and second tracks and generate respective electrical signals indicative thereof. The control system, which preferably includes a digital computer having a predetermined set of instructions programmed therein, is responsive to the electrical signals generated by the plurality of sensors for selectively activating and deactivating the first, second, third and fourth drive means to operate the first and second conveyor tracks and the dividers in accordance with the predetermined set of program instructions. The fourth drive means for operating the dividers is preferably slaved to the third drive means, which operates the second and third chain means, either mechanically or by electrical feedback loop, so that the fourth and fifth chain means, which are used to move the dividers, are driven in conjunction with the second and third chain means. An additional sensor, such as a microswitch or the like, is provided to detect the position of the ramp means and generates an electrical signal when the ramp means is in the substantially horizontal position.

The tray loading system according to the present invention is particularly well-suited for loading beverage containers, either in a loose state or in pre-formed six-packs, eight-packs or twelve-packs into trays for transportation to the respective distribution centers. The system provides relatively high speed, continuous operation and can be effectively used in conjunction with trays of relativly low vertical depth.

BRIEF DESCRIPTION OF THE DRAWINGS

Other objects and advantages of the invention will be apparent from the detailed description and claims when read in conjunction with the accompanying drawings wherein:

DETAILED DESCRIPTION OF THE PREFERRED EMBODIMENT

In the description which follows, like parts are marked throughout the specification and drawings, respectively. The drawings are not necessarily to scale and in some instances proportions have been exaggerated in order to more clearly depict certain features of the invention.

Figure 1:
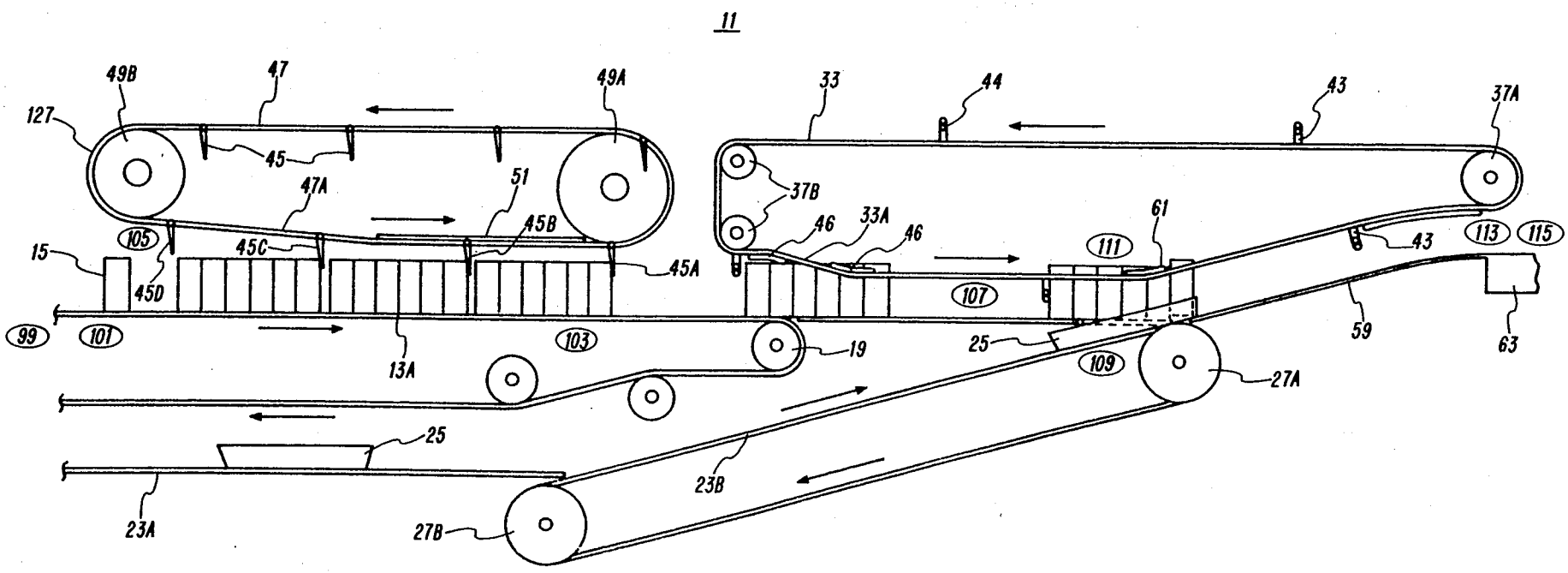
FIGS. 1 and 2 are side elevation views of the tray packing system according to the present invention.
Figure 2:
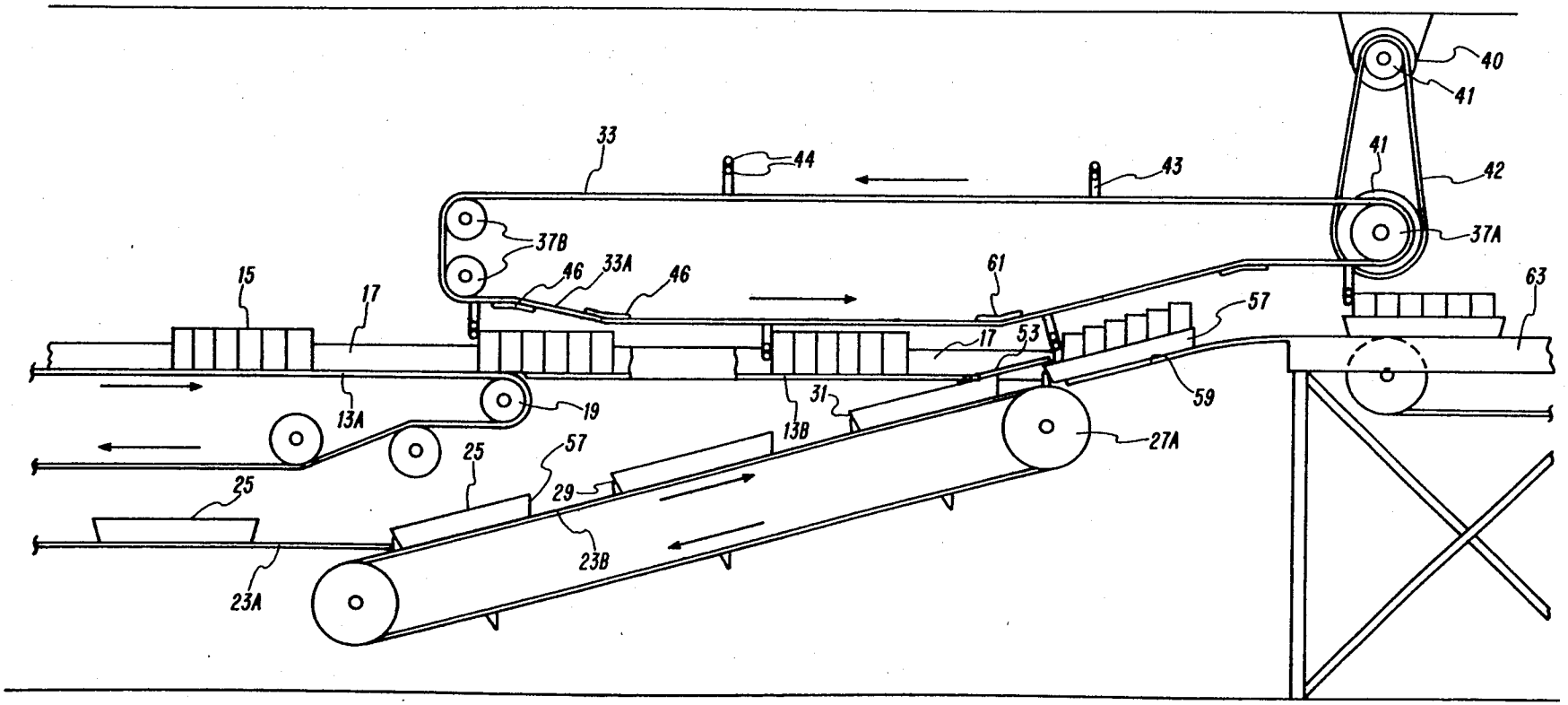

Referring to FIGS. 1 and 2, an automated system for packing beverage containers, such as soft drink cans, into transport trays according to the present invention is depicted. Packing system 11 includes a first conveyor track 13 on which individual beverage containers 15 are transported. Containers 15 may be pre-packaged into six-packs, eight-packs or twelve-packs or, alternatively, individual containers 15 may be transported in a loose state on first conveyor track 13. First conveyor track 13 includes a movable portion 13A, which is preferably comprised of a portion of a first sprocket-driven chain member, and a stationary portion 13B, which may be comprised of one or more chain members, downstream of movable portion 13A. First conveyor track 13 has side walls 17 along substantially the entire length thereof to keep containers 15 on first track 13. End sprocket 19 is preferably driven by an electric motor (not shown) to drive the first chain member comprising movable track 13A in a continuous loop in the direction indicated by the two arrows.

A second conveyor track 23 for transporting individual trays 25 into which containers 15 are to be loaded is comprised of a substantially horizontal portion 23A and a substantially inclined portion 23B, which is downstream of horizontal portion 23A. Inclined portion 23B is preferably comprised of a conveyor belt, which is wound around two opposed drive drums or pulleys 27A and 27B to form a continuous loop. An electric motor (not shown) or other suitable drive mechanism is preferably connected to drive drum 27A for driving inclined track 23B in the direction indicated by the appropriate arrows. Inclined track 23B further includes a plurality of support projections 29 arranged at predetermined intervals therealong for engaging the respective trailing edges 31 of trays 25 to push each tray 25 upwardly along inclined track 23B.

Figure 3:
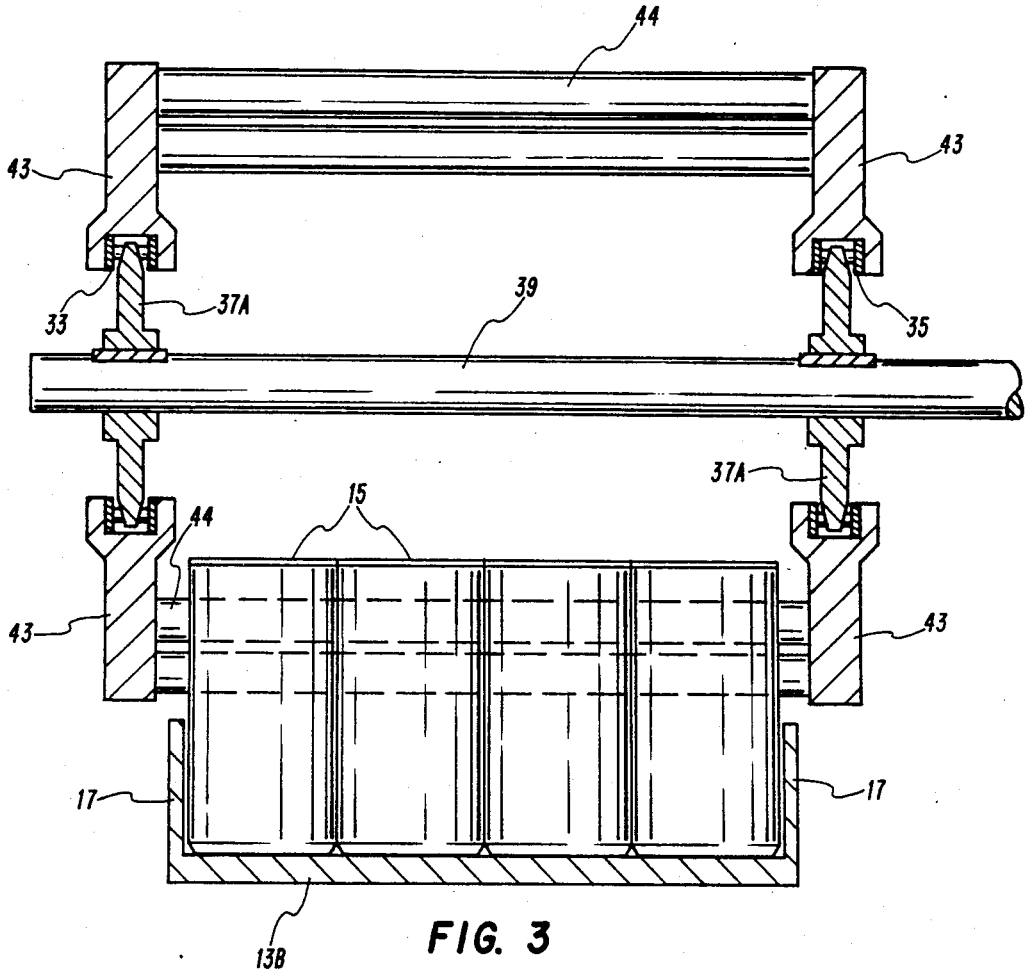
FIG. 3 is an end elevation view of the tray packing system shown in FIGS. 1 and 2, looking from the downstream side toward the upstream side.

Referring also to FIG. 3, containers 15 are transported along stationary track 13B by means of a chain and sprocket arrangement comprising second and third chain members 33 and 35 wound around respective sprocket members 37A and 37B to form respective continuous vertical loops in substantially parallel orientation with respect to one another, as best seen in FIG. 3. Each sprocket member 37A and 37B associated with second chain member 33 is coupled to the corresponding sprocket member 37A and 37B, respectively, associated with third chain member 35 by means of a common shaft 39, which fits within a complementary keyway in the corresponding sprocket members 37A and 37B, thereby allowing second and third chain members 33 and 35 to be driven together in respective continuous vertical loops. A drive motor 40, which is preferably a variable speed AC motor, is coupled to sprocket member 37A on second chain member 33 via pulleys 41 and belt 42 to impart rotational motion to sprocket member 37A and drive second chain member 33. Shaft members 39 connecting corresponding sprocket members 37A and 37B on the respective second and third members 33 and 35 transfer the drive force to third chain member 35 to drive third chain member 25 in conjunction with second chain member 33.

Second and third chain members 33 and 35 each have a plurality of flight bars 43 extending outwardly therefrom at predetermined intervals therealong. Each flight bar 43 on second chain member 33 is connected to the corresponding flight bar 43 on third chain member 35 by means of a series of rollers 44, which span the gap between the corresponding pairs of flight bars 43. Rollers 44 contact the trailing row in each group of containers 15 across substantially the entire width thereof, as best shown in FIG. 3, to move each group of containers 15 along stationary track 13B.

Second and third chain members 33 and 35 preferably include respective portions which extend downwardly at a gradual angle (for example, 5°) with respect to the horizontal, as indicated at 33A by means of shoe plates 46. As flight bars 43 travel along a slightly descending path, they will contact the trailing row in each group of containers 15 at a lower point on each container than if flight bars 43 were moving horizontally. Therefore, containers 15 are less susceptible to being tipped over by the force exerted upon them by flight bars 43. Furthermore, the flight bars can be made of shorter length because inclined portions 33A allow the corresponding flight bars 43 to contact containers 15 at respective lower positions thereon. The shorter the flight bars the less clearance there needs to be between second and third chain members 33 and 35 and adjacent portions of the tray packing system, which reduces the space requirements for the system and the overall cost of operation. One skilled in the art will appreciate, however, that inclined portions 33A can be eliminated and second and third chain members 33 and 35 driven substantially horizontally, but that longer flight bars would have to be used to insure that contact is made low enough on the respective surfaces of containers 15 to prevent containers 15 from tipping over as a result of the force imparted thereto by flight bars 43.

Figure 4:
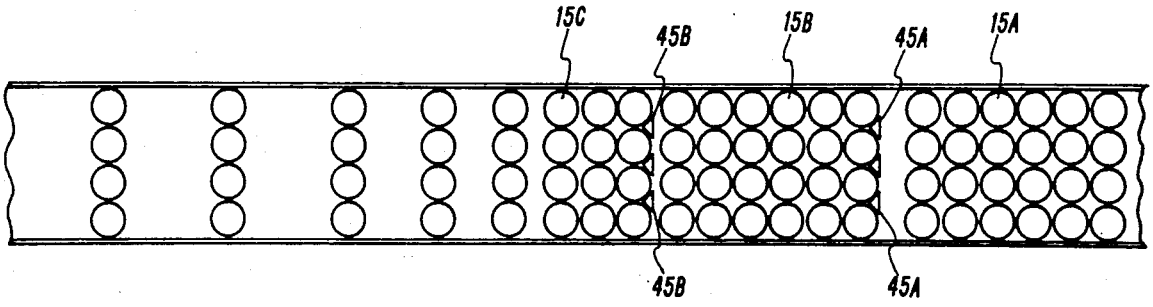
FIG. 4 is a top plan view illustrating the separation of individual beverage containers into discrete groups.

Referring to FIGS. 1 and 4, individual ones of containers 15 are separated into groups of twenty-four containers 15 in each group, corresponding to a standard case of containers. Finger-like dividers 45 are disposed at predetermined intervals along a plurality of mounting bars (not shown), which extend laterally between fourth and fifth sprocket-driven chain members 47 (only one of which is shown in FIG. 1). Each chain member 47 is wound around a pair of sprockets 49A and 49B to form respective continuous vertical loops. Fourth and fifth chain members 47 are disposed in parallel relationship with respect to one another and driven together in much the same manner as second and the third chain members 33 and 35 are driven together, as described above. Dividers 45 are preferably pivotally attached to their respective bars and hang vertically downward therefrom. A retaining bar 51 holds dividers 45A and 45B in a substantially rigid position when dividers 45A and 45B are interposed between containers 15. In an alternate embodiment, dividers 45 are held in a rigid position at all times and are therefore not able to swing freely with respect to their corresponding mounting bars.

Dividers 45 are interposed between selected rows of containers 15 on movable track 13A and dividers 45 are moved by fourth and fifth chain members 47 in the direction of movement of movable track 13A, but at a somewhat slower speed than movable track 13A so that a relative speed differential is maintained between those containers 15 on the downstream side of dividers 45A and those containers 15 on the upstream side thereof, as best illustrated in FIG. 4. If containers 15 are arranged as shown in FIG. 1, with six rows, each containing four containers 15 extending laterally across movable track 13A, each lateral mounting bar will have three dividers 45 extending therefrom so that one divider 45 is interposed between adjacent containers 15 in the leading row of each group of containers 15. Each set of dividers 45 on a particular mounting bar is separated from the next adjacent set by approximately the length of each group of containers 15, as measured longitudinally along movable track 13A. One skilled in the art will appreciate that containers 15 can also be arranged in groups of twenty-four containers 15 each, with four rows, each containing six containers 15. In that event, each lateral mounting bar will have five dividers 45 extending therefrom.

Respective portions 47A of fourth and fifth chain members 47 extend downwardly at a gradual angle (for example, 5°) with respect to a horizontal axis, to allow dividers 45 to move gradually downward over the tops of containers 15 into position between containers 15, as best illustrated by dividers 45C and 45D in FIG. 1. The operation of dividers 45 is timed so that a case consisting of twenty-four individual containers 15 will be grouped together between adjacent sets of dividers 45.

FIG. 4 illustrates three different cases of containers 15, each consisting of twenty-four individual containers 15, in the process of being formed on movable track 13A. Case 15A is moving downstream along movable track 13A at a relative speed differential with respect to case 15B because case 15A is no longer being held back by dividers 45. Thus, case 15A moves at the speed of movable track 13A, while case 15B is confined by first set of dividers 45A, which is in contact with the leading row of case 15B, thereby limiting the speed of movement of case 15B to the speed of movement of dividers 45A. Upstream of second set of dividers 45B, a third case 15C is being formed or has been formed as the individual containers 15 stack up on the upstream side of dividers 45B. As fourth and fifth chain members 47 continue their movement, dividers 45A will move upwardly and away from the leading row of case 15B to allow case 15B to move downstream at the speed of movable track 13A. The net result of the above-described operation is that individual containers 15 will be grouped into cases consisting of twenty-four containers 15. Each case will be spaced apart sufficiently to allow the corresponding flight bars 43 to make contact with the trailing row of containers 15 in each case, as best seen in FIG. 1. One skilled in the art will appreciate that fourth and fifth chain members 47 may be positioned beneath movable track 13A in an alternate embodiment so that dividers 45 are interposed between containers 15 from underneath.

Referring to FIGS. 2 and 5A–5I, a ramp 53 is pivotally attached at the downstream end of stationary track 13B. Ramp 53 is mounted so as to be rotatable in an upward direction about an axis extending laterally across stationary track 13B. Ramp 53 includes an extension portion 55 which engages the under-surface of stationary track 13B to act as a stop and prevent ramp 53 from being rotated below a substantially horizontal position at the level of stationary track 13B. Each case of containers 15 is pushed off ramp 53 by the corresponding flight bar 43 into the corresponding tray 25. As each tray 25 moves up inclined track 23B, trailing edge 31 of the corresponding tray 25 that is being filled will contact ramp 53 and ramp 53 pivots upwardly to allow tray 25 to continue its upward movement along inclined track 23B.

Figure 5A:
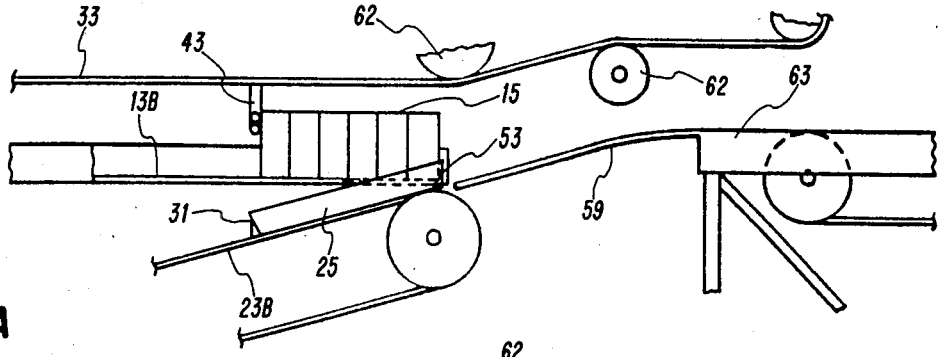
FIGS. 5A–5I are side elevation views of a portion of the tray packing system of FIGS. 1 and 2, showing the successive steps in which containers are loaded into the trays.
Figure 5B:
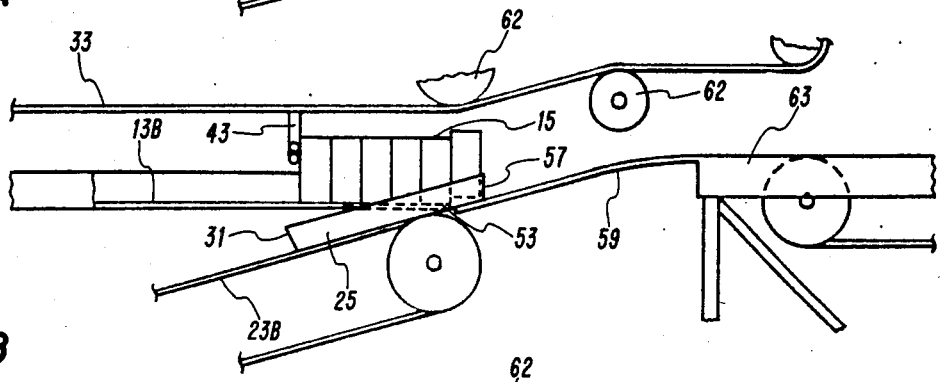

Referring specifically to FIGS. 5A and 5B, when the downstream end of ramp 53 clears edge 57 of each tray, ramp 53 will return to a substantially horizontal position. At this point, the leading row of containers 15 has reached the upstream edge of extension portion 55 of ramp 53.

Figure 5C:
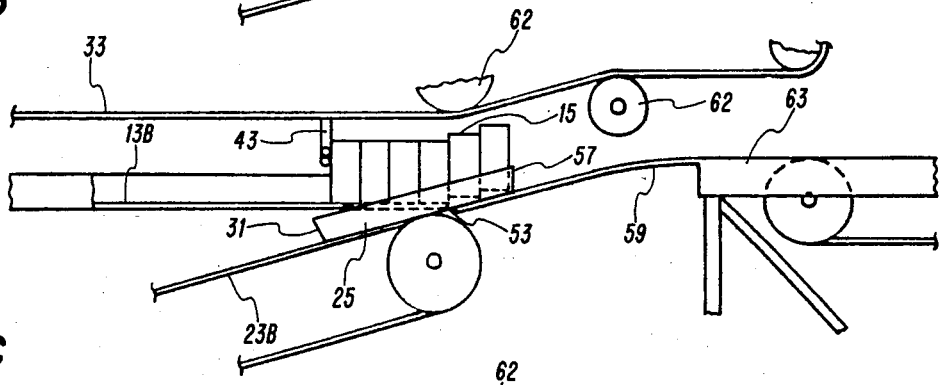
Figure 5D:
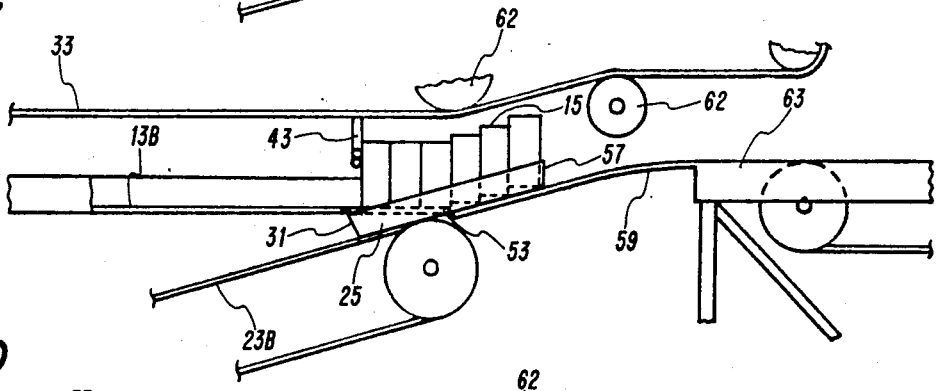

Referring to FIG. 5B, a flight bar 43 continues to push each case of containers 15 downstream and tray 25 continues to move upwardly along inclined track 23B so that the leading row of containers 15 is loaded into tray 25. The leading row is maintained in a substantially vertical orientation and is sandwiched between leading edge 57 of tray 25 and the second row of containers 15. The bottom surface of tray 25 is oriented at a substantially acute angle with respect to the corresponding bottom surfaces of containers 15. The second and third rows of containers 15 are loaded in tray 25 in substantially the same manner, as shown in FIGS. 5C and 5D, as flight bar 43 continues to push containers 15 downstream along stationary track 13B and the corresponding tray 25 continues its upward movement along inclined track 23B.

Figure 5E:
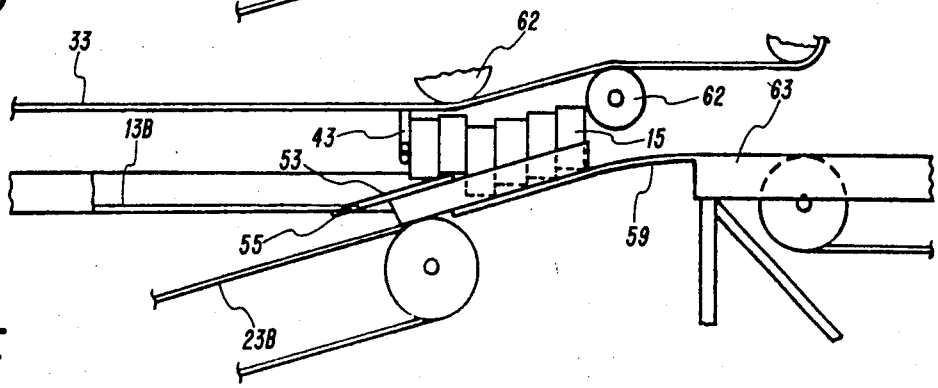
Figure 5F:
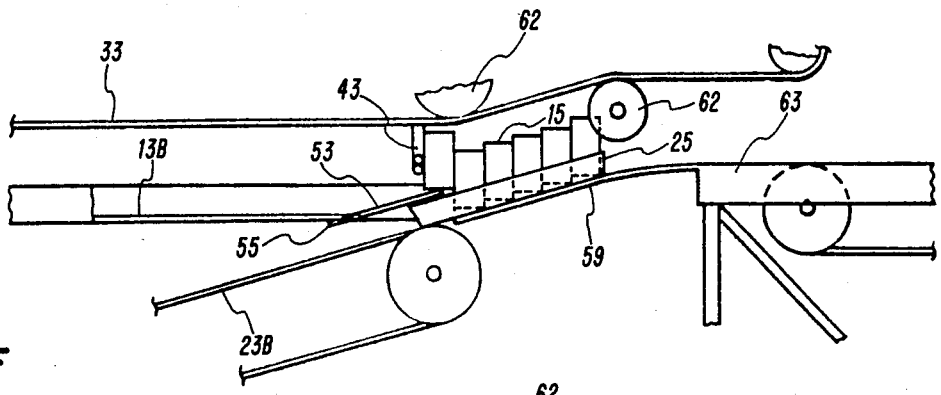
Figure 5G:
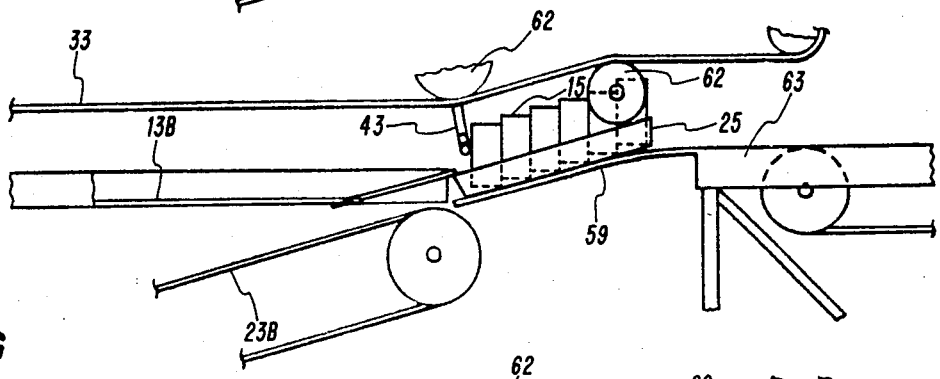

Referring specifically to FIG. 5B, ramp 53 will begin to move upwardly again as it comes into contact with trailing edge 31 of tray 25. Thus, the fourth, fifth and sixth rows of containers 15 will be pushed off the front edge of ramp 53 by flight bar 43 and drop a short vertical distance downward into tray 25, as shown in FIGS. 5E, 5F and 5G. One skilled in the art will recognize that each row of containers 15 is maintained in a relatively stable vertical orientation during the packing process by the container row immediately in front and immediately behind it, except for the first container row, which is stabilized in front by leading edge 57 of the corresponding tray 25, and the sixth container row, which is stabilized from behind by flight bar 43. Side walls 17 on either side of ramp 53 stabilize containers 15 laterally as containers 15 are loaded into corresponding trays 25.

Figure 5H:
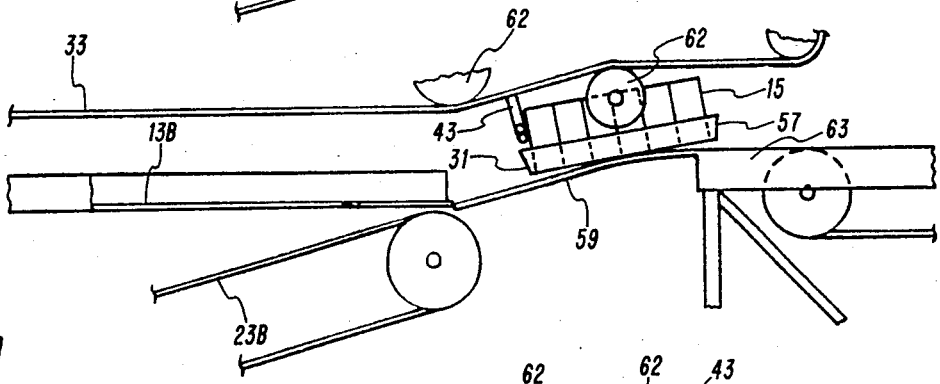

Referring to FIGS. 5G and 5H, all twenty-four containers 15 in each case are shown in the packed position within the corresponding tray 25 according to the above-described process. At this point, tray 25 is transported upwardly along a stationary inclined track 59 by the corresponding flight bar 43. Second and third chain members 33 and 35 are inclined upwardly, as shown at 33B, along substantially the same angle as inclined track 59, by means of a shoe plate 61 (FIGS. 1 and 2) or an idler sprocket 62 (FIGS. 5A–5I) so that the force imparted by the corresponding flight bar 43 will be directed substantially parallel with respect to inclined track 59.

Figure 5I:
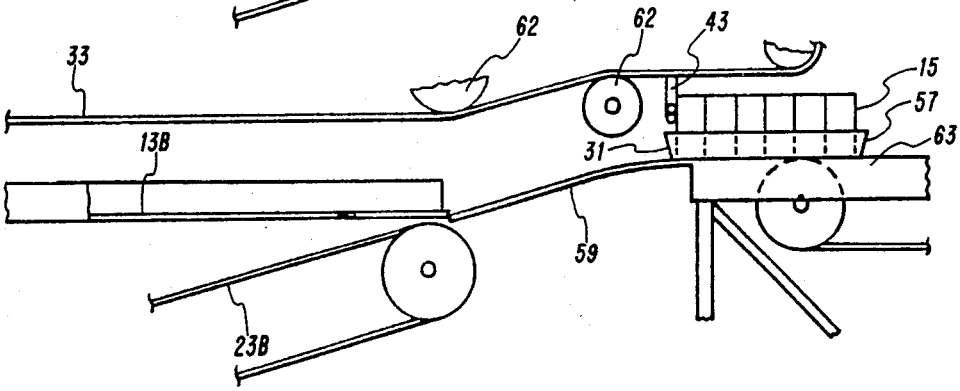

The corresponding bottom surfaces of each container 15 will remain oriented at an angle with respect to the bottom surface of tray 25 until tray 25 returns to a substantially horizontal position on a movable third conveyor track 63, as shown in FIGS. 5H and 5I. Shortly after the loaded tray 25 is transported onto third conveyor track 63, flight bar 43 rotates upwardly around drive sprocket 37A and becomes disengaged from the trailing row of containers 15. Tray 25 is transported downstream by the drive mechanism (not shown) associated with third conveyor track 63 to the next destination.

The tray packing system according to the present invention includes separate apparatus (preferably adjustable speed AC motors) for driving first chain member 13A, second conveyor track 23 and second and third chain members 33 and 35. Fourth and fifth chain members 47 may be mechanically slaved to second and third chain members 33 and 35 so as to be driven thereby or, alternatively, fourth and fifth chain members 47 may be equipped with a separate drive apparatus, which is electrically slaved by means of a feedback loop to the drive apparatus for second and third chain members 33 and 35. In order to effect a smooth transition between movable track 13A on which containers 15 are transported and stationary portion 13B on which flight bars 43 impart the motive force to containers 15, the speed of second and third chain members 33 and 35 must be equal to or greater than the speed of fourth and fifth chain members 47. The apparatus for driving first chain member 13A, second conveyor track 23, second and third chain members 33 and 35 and fourth and fifth chain members 47 will hereinafter be referred to as Drive 1, Drive 2, Drive 3 and Drive 4, respectively.

In the embodiment described above with reference to FIGS. 5A—5I, ramp 53 is lifted up by trailing edge 31 of the tray 25 being packed and leading edge 57 of the next tray 25 in sequence. Referring to FIGS. 6 and 7, an alternate embodiment for lifting ramp 53 is depicted. A cam 65 is attached by means of a link pin 67 to each of second and third chain members 33 and 35 at predetermined locations therealong, just upstream of each flight bar 43. A push rod follower 69 is attached to extension portion 55 of ramp 53 on each side of stationary track 13B, for engaging cam 65 as cam 65 moves past push rod follower 69 along with the respective second and third chain members 33 and 35.

Figure 6A:
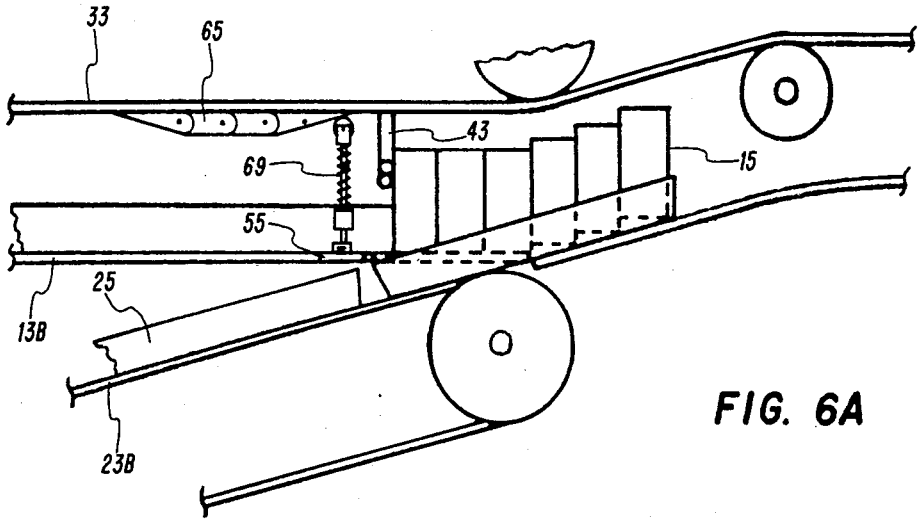
FIGS. 6A–6C are side elevation views of a portion of the tray packing system according to the present invention, showing a push rod follower mechanism for lifting the packing ramp on the container conveyor track.
Figure 7A:
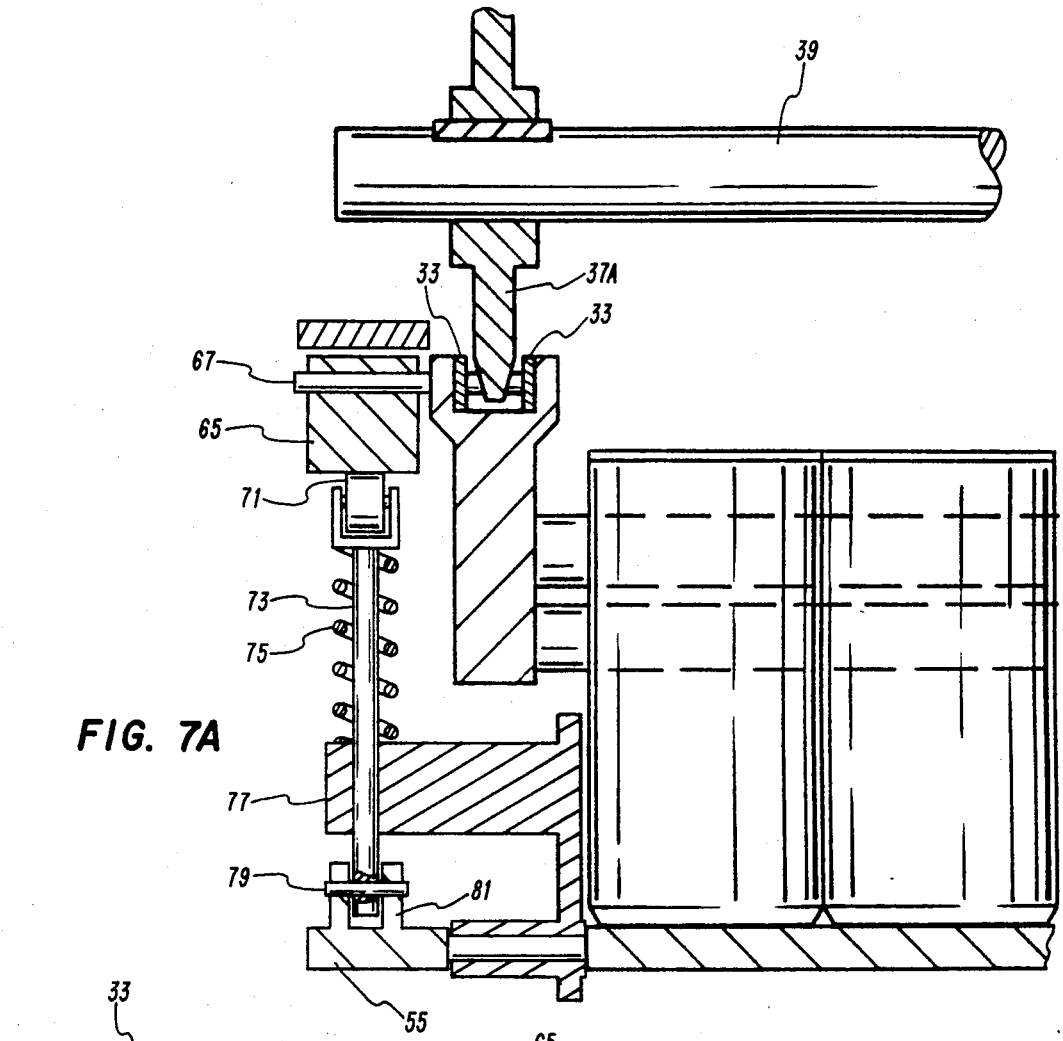
FIGS. 7A and 7B are respective sectional and side elevation views of the push rod follower mechanism shown in FIGS. 6A and 6B.
Figure 7B:
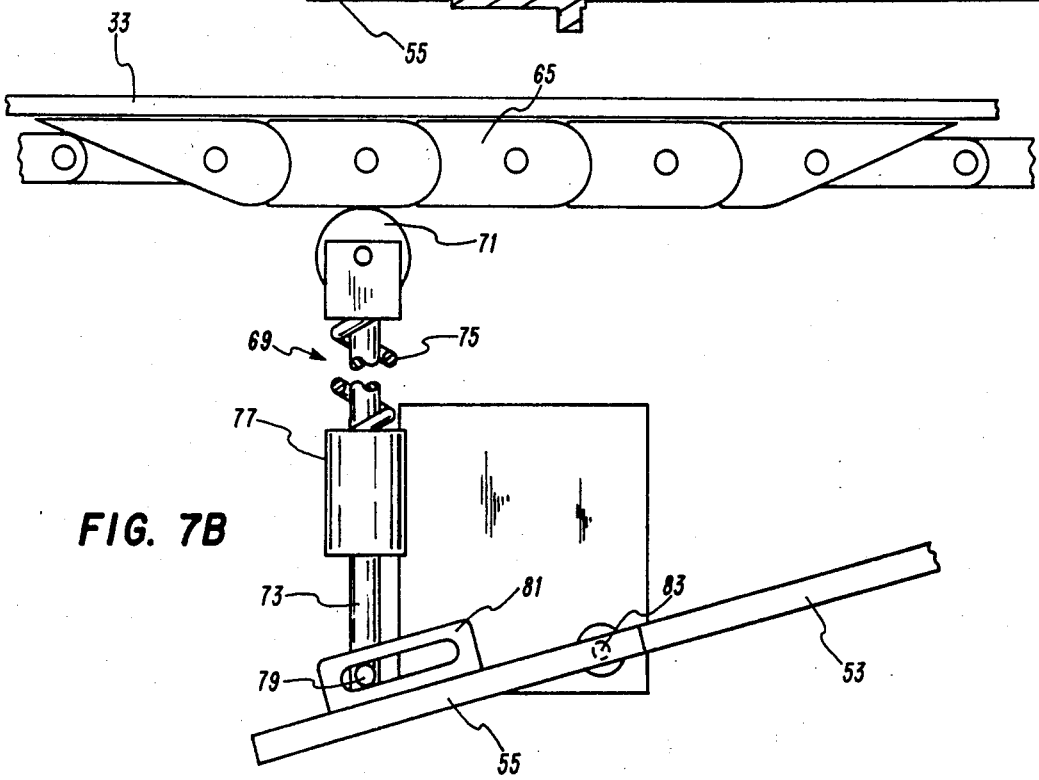

As best seen in FIGS. 7A and 7B, push rod follower 69 is spring-biased toward the position shown in FIG. 6A, at which ramp 53 is in a substantially horizontal position as shown. Push rod follower 69 includes a cam follower 71 for engaging cam 65, an elongated shaft 73 on which spring member 75 is mounted, a guide 77, which constrains shaft 73 to move in a substantially vertical direction, a pin member 79 extending perpendicularly with respect to the axis of shaft 73 and a slotted bracket 81 mounted on extension portion 55 of ramp 53.

Figure 6B:
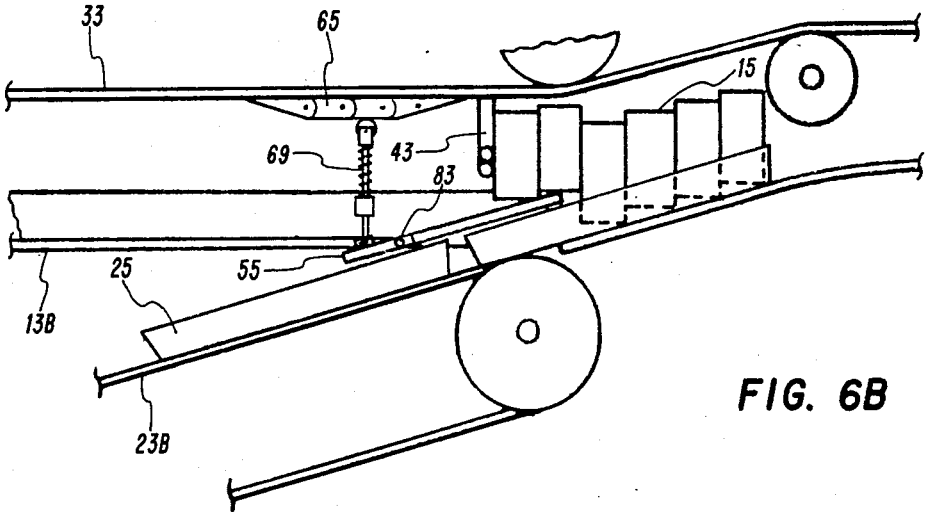
Figure 6C:
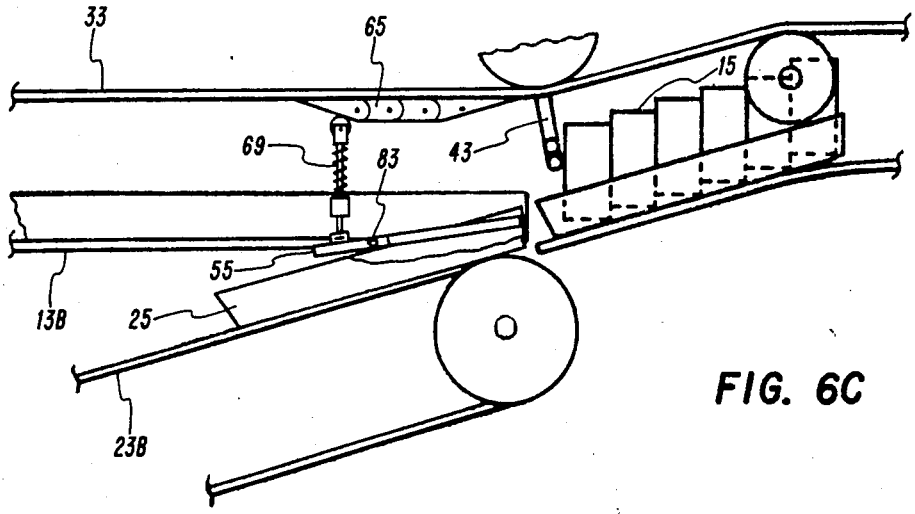

Referring specifically to FIGS. 6B, 7A and 7B, cam follower 71 is moved downwardly against the bias of spring member 75 as cam 65 passes over cam follower 71. When shaft 73 of push rod followed 69 is moved vertically downwardly by cam 65, it pushes down on extension portion 55, which pivots ramp 53 about pivot point 83, thereby raising ramp 53 upwardly to facilitate the passage of trays 25. Ramp 53 is lifted as required without relying on the lifting action of trailing edge 31 of the tray 25 being filled and leading edge 57 of the next tray 25 in sequence, which may cause stresses and possible damage to the edges of trays 25. Cam 65 and push rod follower 69 will cooperate to lift ramp 53 at the point where trailing edge 31 of each tray 25 contacts ramp 53, as best shown in FIG. 6A. Thus, the length of cam 65 must be greater than the longitudinal extent of containers 15 remaining on ramp 53 and not yet loaded into the corresponding tray 25. For example, in FIG. 6A, three rows of containers 15 are shown resting on ramp 53. Cams 65 are of sufficient length to hold the corresponding push rod followers 69 in a downard position to maintain ramp 53 in a raised position as shown until all of containers 15 have been loaded into the corresponding tray 25 and leading edge 57 of the next tray 25 in sequence has cleared the downstream end of ramp 53 to allow the next case of containers 15 in sequence to be loaded into the next tray 25 in sequence in the same manner as described above. Cams 65 are positioned on respective second and third chain members 33 and 35 so that the leading edge of each cam 65 will contact cam follower 71, as shown in FIG. 6A, at or just prior to when trailing edge 31 of the corresponding tray 25 would contact ramp 53 downstream of pivot point 83, as shown in FIG. 6A.

Figure 8A:
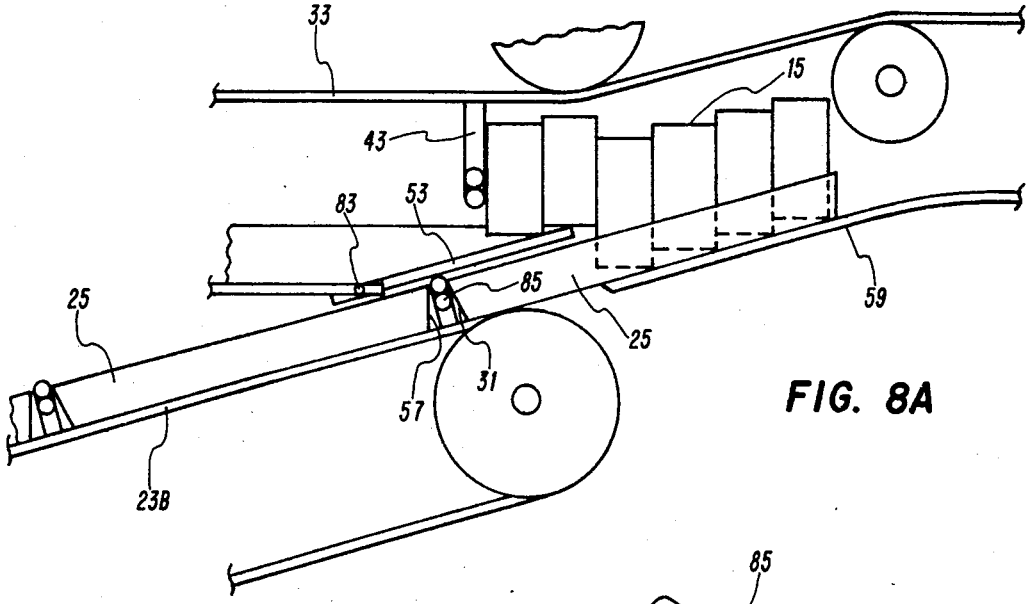
FIGS. 8A and 8B are respective side elevation and perspective views of a first roller mechanism used to lift the packing ramp according to the present invention.
Figure 8B:
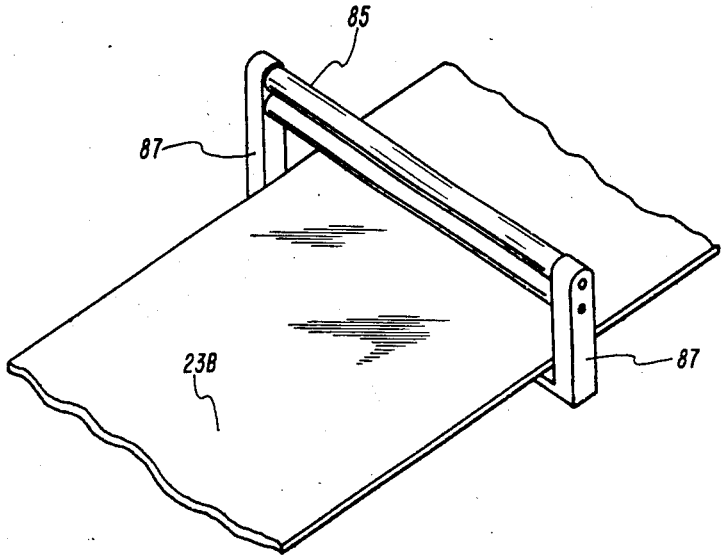

Referring to FIGS. 8A and 8B, an alternate embodiment of an apparatus for selectively lifting ramp 53 is depicted. Each tray 25 is sandwiched between a pair of rollers 85 adjacent to both leading edge 57 and trailing edge 31 of each tray 25. Rollers 85 are mounted at their respective opposite ends on support bars 87, which are positioned on opposite sides of second conveyor track 23B and are movable along with second conveyor track 23B. The upper roller 85 extends upwardly slightly higher than the upper edge of the corresponding tray 25, as best seen in FIG. 8A so that upper roller 85 engages ramp 53 and lifts it up to pave the way for tray 25 to pass beneath ramp 53 unobstructed. The corresponding rollers 85 positioned behind trailing edge 31 of each tray 25 operate in substantially the same manner to lift ramp 53 as trailing edge 31 passes underneath ramp 53, as best seen in FIG. 8A.

Figure 9:
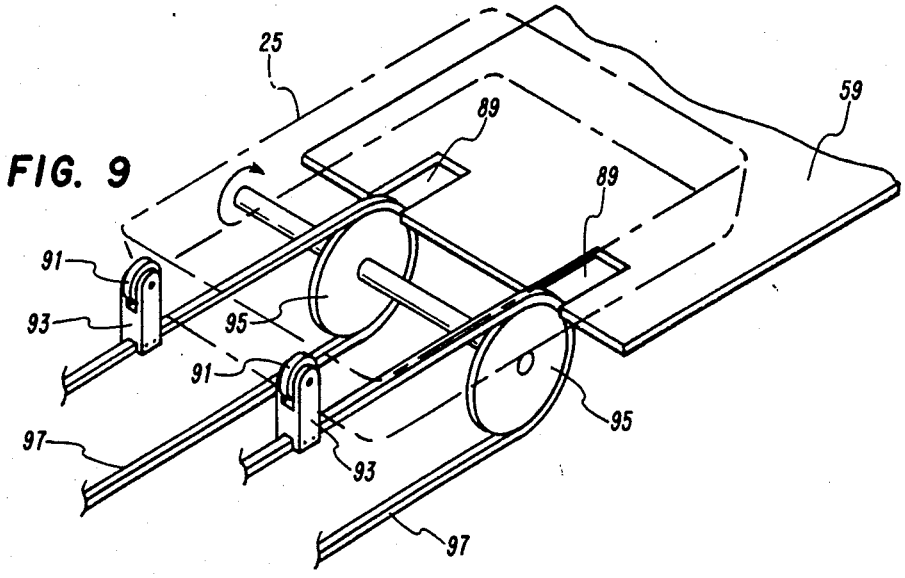
FIG. 9 is a perspective view of a second roller mechanism used to lift the packing ramp according to the present invention, illustrating the transition between movable and stationary portions of the tray conveyor track in the tray packing system according to the present invention.

Referring to FIG. 9, yet another embodiment for raising ramp 53 is depicted. The upstream edge of stationary inclined track 59 has a pair of longitudinally oriented slots 89 disposed therein for allowing a pair of rollers 91, which are mounted on respective support stands 93, to reverse directions around respective drive sprockets 95 as the respective chain members 97 reverse directions. In the embodiment shown in FIG. 9, second conveyor track 23B is comprised of parallel chain members 97 on which trays 25 are transported. Rollers 91 extend upwardly above the upper edge of each tray 25 so as to lift up ramp 53 in substantially the same manner as described above with reference to rollers 85 in FIGS. 8A and 8B. Each tray 25 is sandwiched between respective pairs of rollers 91 adjacent to leading edge 57 and trailing edge 31 of each tray 25.

Figure 10A:
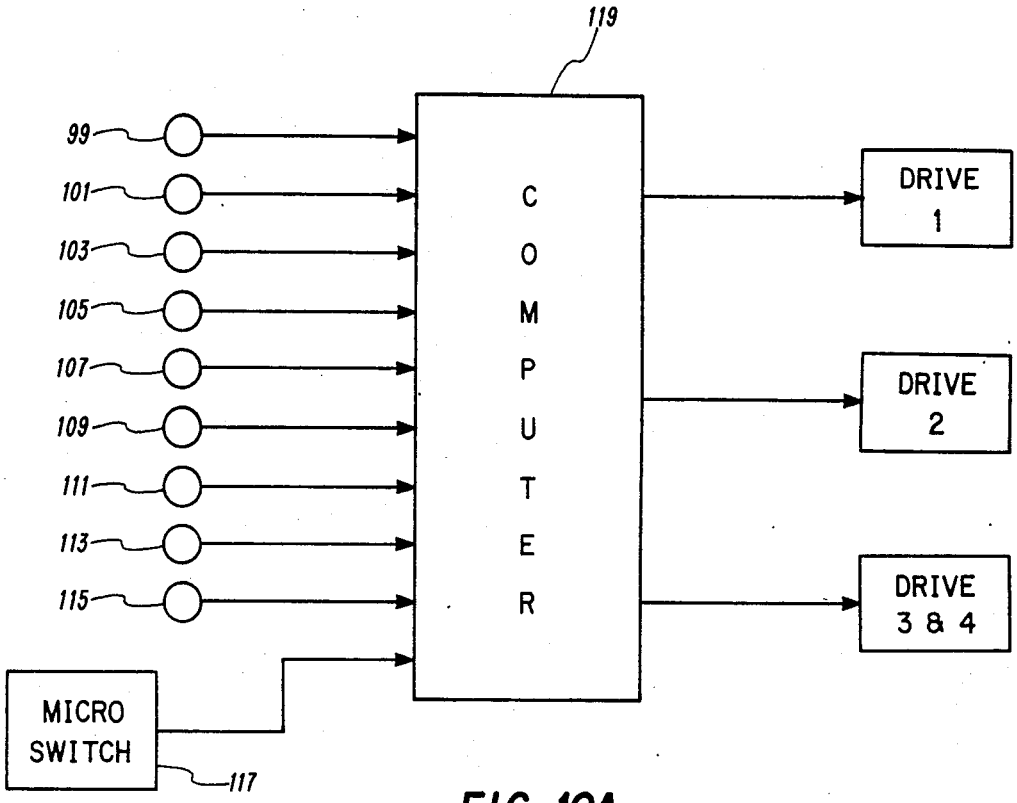
FIGS. 10A and 10B are block diagrams of the computer control apparatus for the tray packing system according to the present invention.
Figure 10B:
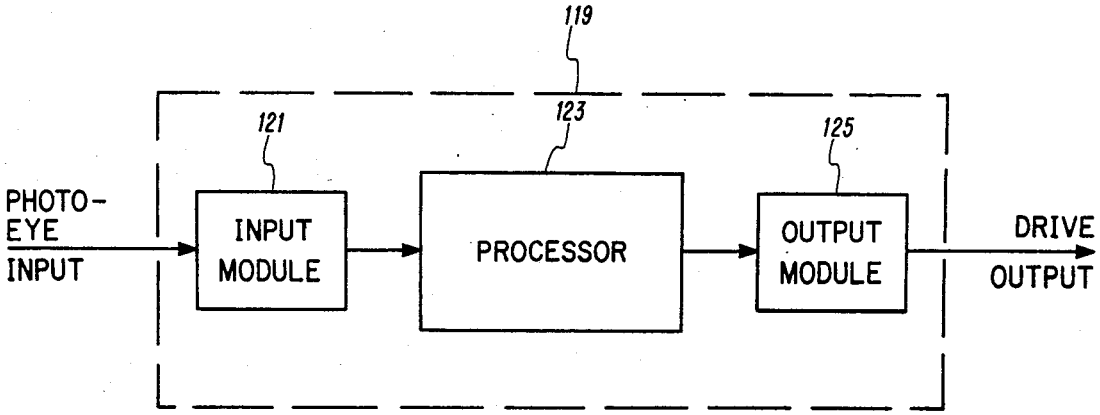

Referring again to FIG. 1 and also to FIGS. 10A and 10B, tray packing system 11 in accordance with the present invention uses a plurality of sensors to detect the presence and movement of containers 15 and trays 25 on their respective tracks. The sensors used may be photoelectric detectors (i.e., photoeyes), proximity switches, electromechanical microswitches or other suitable devices. Nine such sensors 99, 101, 103, 105, 107, 109, 111, 113, and 115 are positioned as shown in FIG. 1. The control algorithm for tray packing system 11 will be described below with reference to photoeyes as being the primary sensors. One skilled in the art will appreciate, however, that other types of sensors as mentioned above can be used to achieve substantially the same result and that the invention is not limited to the use of photoeye sensors. In addition to the nine photoeyes selectively positioned at various locations along the conveyor tracks, a microswitch 117 is used to detect the position of ramp 53 (i.e., whether ramp 53 is in the horizontal position or in the raised position). When ramp 53 is in the raised position, the microswitch is closed and an electrical signal indicative thereof is generated. On the other hand, when ramp 53 is in the horizontal or "down" position, the microswitch will remain open so that no electrical signal is generated.

Referring specifically to FIGS. 10A and 10B, the heart of the control system is a digital computer 119, which receives inputs from photoeyes 99–115 and from microswitch 117 and controls the operation of Drives 1, 2, 3 and 4. Drives 1, 2 and 3 preferably include respective variable speed AC motors for driving first chain member 13A, second conveyor track 23B, and second and third chain members 33 and 35, respectively. Drive 4, which includes fourth and fifth chain members 47 and sprocket members 49A and 49B, is preferably mechanically slaved to Drive 3 so as to be driven in conjunction therewith.

Referring to FIG. 10B, computer 119 includes an input module 121 for receiving input signals from the various photoeyes 99–115 and microswitch 117 and reducing the voltage of the input signals to a voltage suitable for information processing by processor 123. Processor 123 is responsive to the various sensor input signals for generating respective output signals to control Drives 1, 2, 3 and 4. An output module 125, which includes one or more inverters for converting DC voltage to AC voltage, increases the voltage of the output control signals from processor 123 to operate the AC motors associated with Drives 1, 2 and 3.

Referring to FIG. 1, photoeyes 99 and 101 cooperate to detect any gaps in the flow of containers 15 along movable track 13A. The distance between photoeyes 99 and 101 is preferably less than or equal to the length of each case of containers 15, as measured longitudinally along first track 13A. Both photoeyes 99 and 101 are located upstream of leading edge 127 of fourth and fifth chain members 47. Photoeye 103 is positioned to indicate the presence of a complete case of containers 15 between dividers 45A and 45B. Photoeye 105 is used during system start-up to properly position dividers 45 to engage containers 15. Photoeye 107 is located at the upstream end of ramp 53 and is used to detect the presence of containers 15 on stationary track 13B in the area of ramp 53. Photoeye 109 is located adjacent to inclined track 23B for detecting the presence of trays 25 in the packing area. Photoeye 111 is located at the downstream end of ramp 53, above the level of trays 25, for detecting the presence of containers 15 on ramp 53. Sensors 113 and 115 cooperate to detect the presence of a blockage in the system downstream on third conveyor track 63.

Figure 11:
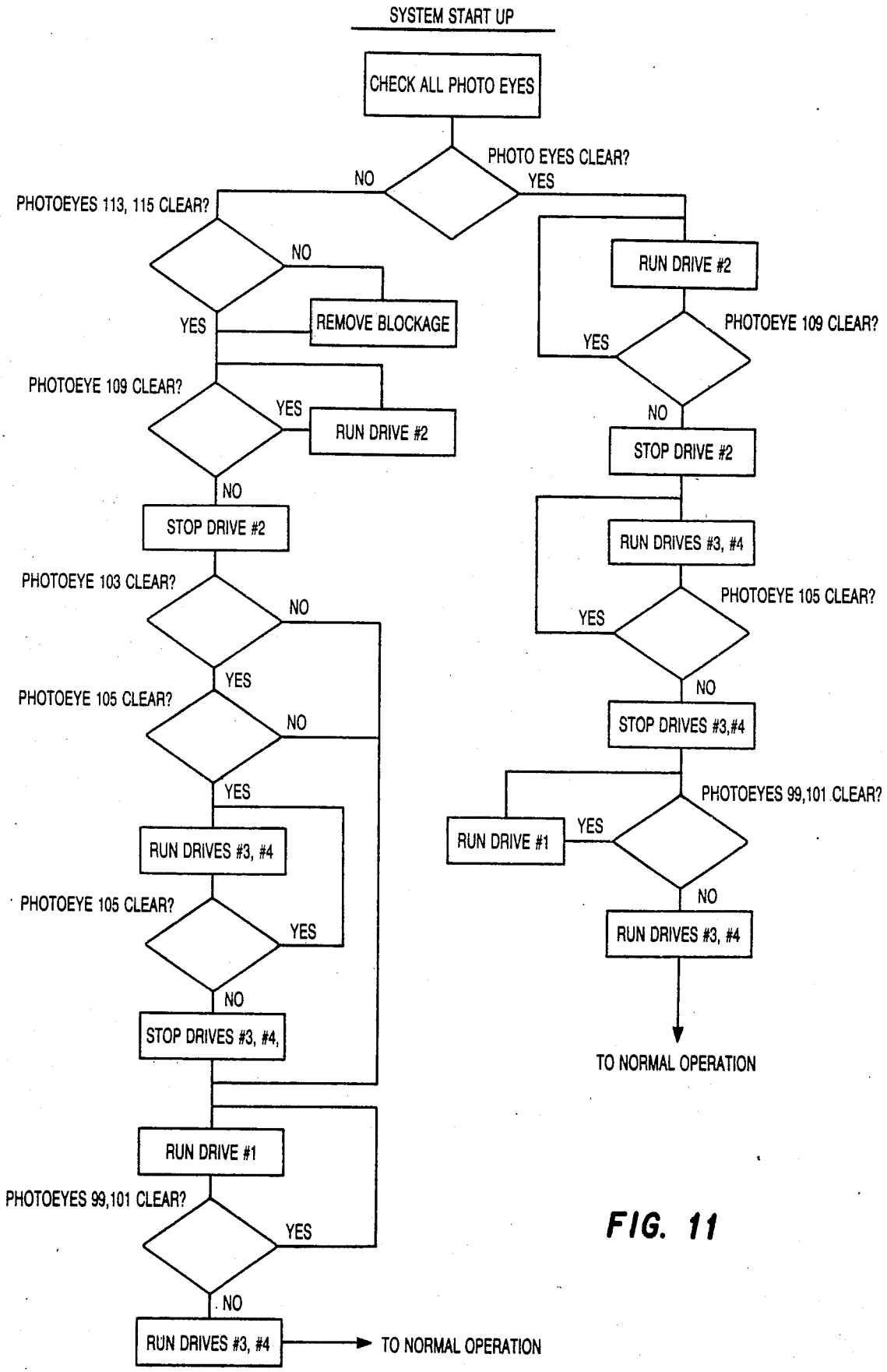
FIGS. 11–14 are flow diagrams illustrating the control algorithm for the tray packing system according to the present invention.
Figure 12:
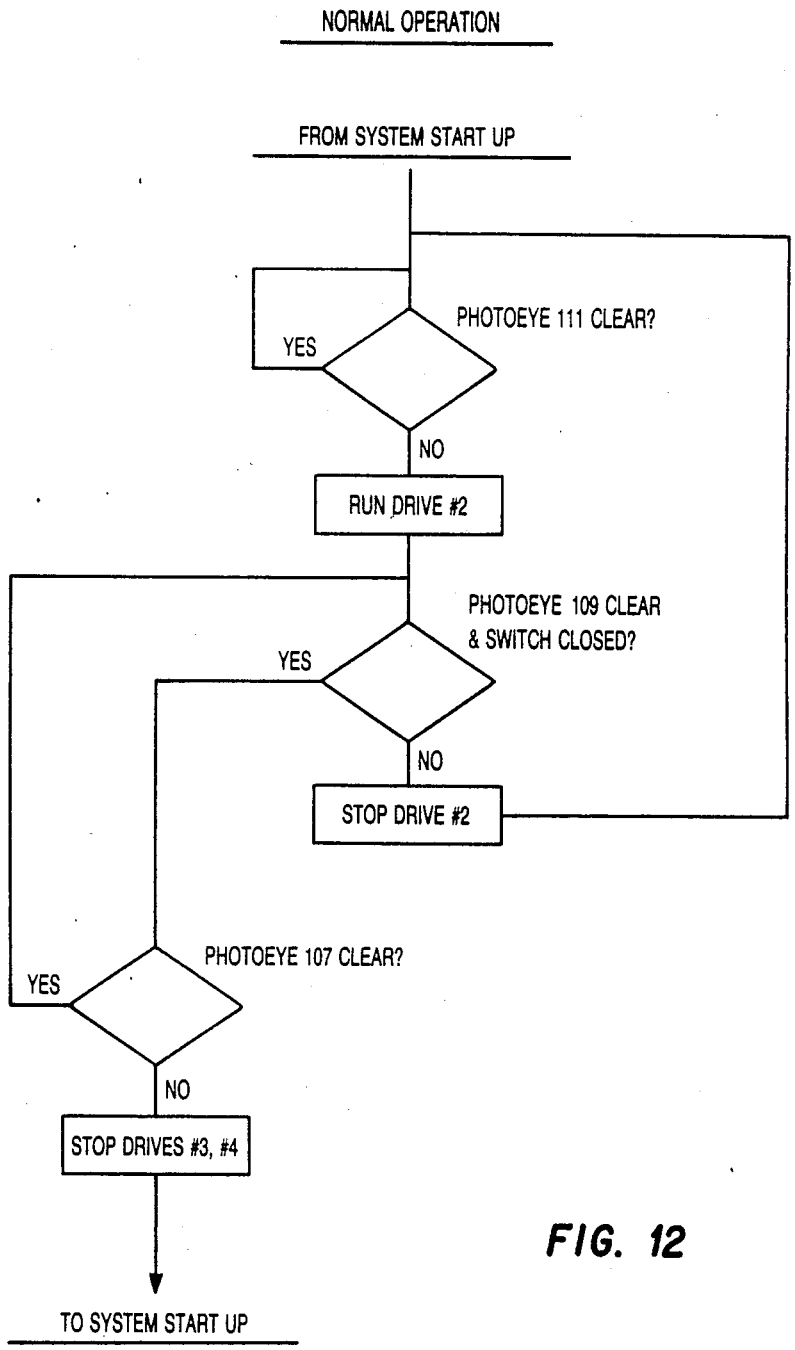

Referring to FIGS. 11–14, the control algorithm for tray packing system 11 is depicted by a series of flow diagrams. The control algorithm is preferably pre-programmed in computer 119. Referring to FIG. 11, the System Start-Up routine is depicted. If all photoeyes are "clear" (i.e., not "blocked" by an object such as container 15 or tray 25), computer 119 will operate Drive 2 until photoeye 109 is blocked, which indicates that a tray 25 is in the proper position for receiving containers 15. At this point, Drive 2 is stopped and computer 119 activates Drives 3 and 4 until photoeye 105 is blocked, which indicates that dividers 45 are properly positioned to engage containers 15. Drive 1 is then started to bring containers 15 into engagement with dividers 45. When photoeye 99 and 101 are blocked, indicating the presence of containers 15 at both positions, Drives 3 and 4 are restricted and the system enters the "Normal Operation" mode, as depicted in FIG. 12.

If, however, all of the photoeyes do not indicate "clear" at the beginning of System Start-Up, the program will branch to the sequence of steps indicated on the left side of FIG. 11. If photoeyes 113 and 115 are blocked, this indicates the presence of a downstream blockage on third conveyor track 63. This blockage must be removed so that photoeyes 113 and 115 are clear. Photoeye 109 is then checked to determine whether a tray 25 is in position at ramp 53 to receive containers 15. If photoeye 109 is clear, Drive 2 is run until photoeye 109 is blocked, which indicates that a tray 25 is properly positioned, at which time Drive 2 is stopped.

Photoeye 103 is then checked to determine whether containers 15 are properly positioned between dividers 45. If photoeye 103 is not clear, Drive 1 is activated. When photoeyes 99 and 101 indicate the presence of containers 15, Drives 3 and 4 are also activated and the system enters the "Normal Operation" mode.

If photoeye 103 is clear, photoeye 105 will be checked to determine whether dividers 45 are properly positioned. If photoeye 105 is blocked, Drive 1 will be activated to bring containers 15 into position. If photoeye 105 is clear, Drives 3 and 4 are activated until dividers 45 are in the proper position, which will occur when photoeye 105 is blocked. Drives 3 and 4 will then be stopped and will be re-started when photoeyes 99 and 101 are blocked, whereupon the system enters the "Normal Operation" mode.

Referring to FIG. 12, the normal operation of tray packing system 11 is depicted. Drive 1 runs continuously, Drive 2 runs upon demand to keep trays 25 in proper position and Drives 3 and 4 run continuously until certain conditions occur or an emergency signal is sent to stop the entire system. During normal operation, photoeye 111 is continually checked to insure that containers 15 are in the packing position on ramp 53. Drive 2 is not activated to move trays 25 until photoeye 111 is blocked. Drive 2 will be run until photoeye 109 is blocked by a tray 25 and microswitch 117 is open (i.e., ramp 53 is horizontal). If tray 25 is not properly positioned, as indicated by photoeye 109 being clear or by microswitch 117 being closed, photoeye 107 will be checked to determine whether containers 15 are getting ready to enter the packing position on ramp 53. If photoeye 107 is blocked, Drives 3 and 4 will be stopped and the System Start-Up routine, as indicated in FIG. 11 will be used to begin operation of the system anew. If, on the other hand, photoeye 107 is clear, photoeye 109 and microswitch 117 will be checked again and Drive 2 will be stopped if a tray 25 is in the proper position to receive containers 15 (i.e., photoeye 109 is blocked and microswitch 117 is open).

Figure 13:
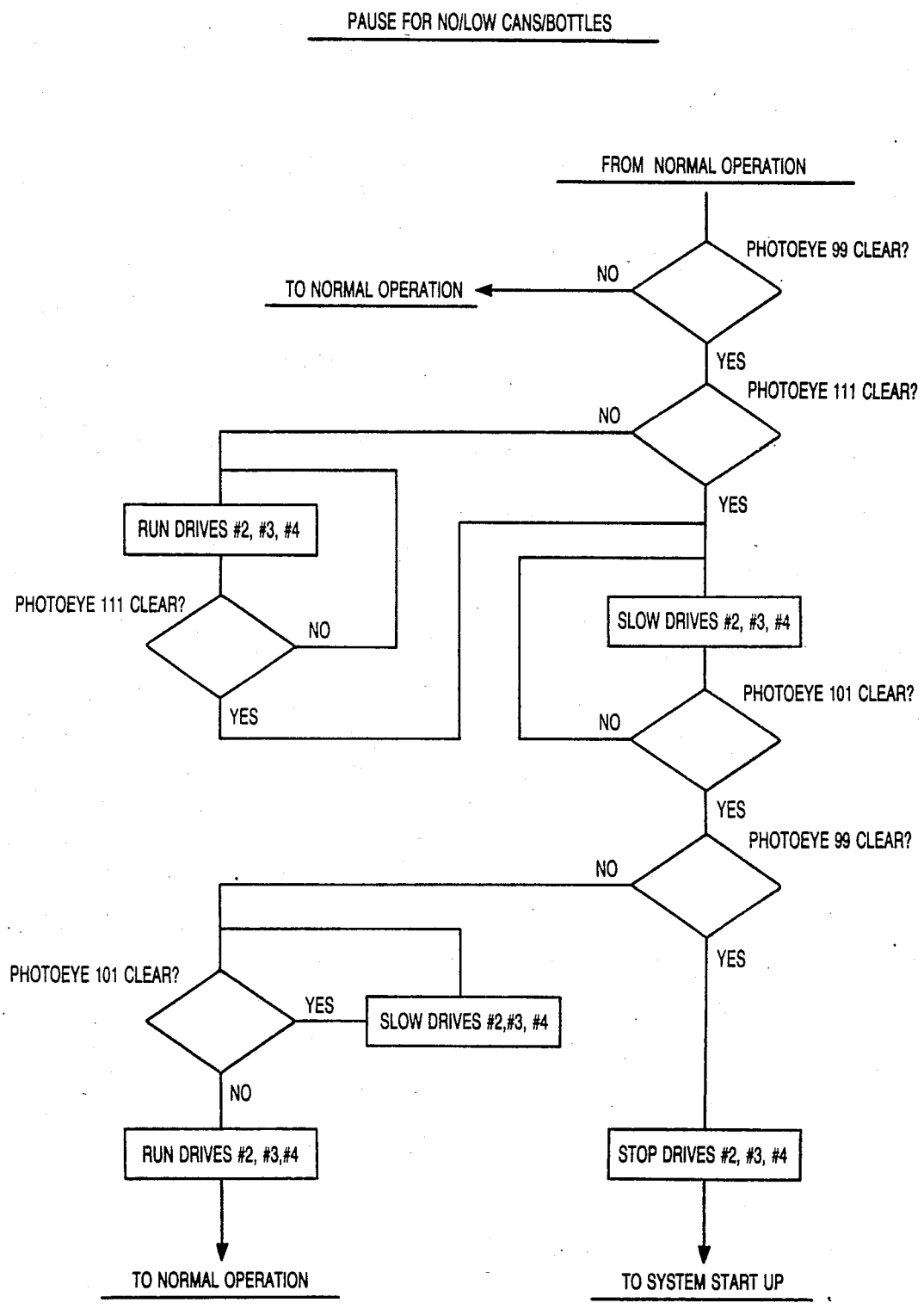

Referring to FIG. 13, an absence or an insufficient number of containers 15 on first conveyor track 13A may cause temporary pauses in the operation of tray packing system 11. If photoeye 99 is clear, photoeye 111 will be checked to see if containers 15 are in the packing position on ramp 53. If photoeye 111 is clear, Drives 2, 3 and 4 will be slowed to approximately one-half their respective normal rates. If photoeye 111 is blocked, Drives 2, 3 and 4 will continue to run at normal speed to allow those containers 15 on ramp 53 to be loaded into the corresponding tray 25. If, after those containers 15 have been loaded, photoeye 111 indicates clear, Drives 2, 3 and 4 will be slowed. Photoeye 101 acts as a secondary indicator of a no/low container condition. If photoeye 101 is clear at the same time that photoeye 99 is clear, Drives 2, 3 and 4 will be stopped. If photoeye 99 is blocked, photoeye 101 will be checked and if it is also blocked, Drives 2, 3 and 4 will be run at full speed. If photoeye 99 is blocked and photoeye 101 is clear, Drives 2, 3 and 4 will run at slow speeds until both photoeyes 99 and 101 are blocked, which indicates sufficient containers 15 on movable track 13A for normal system operation. If Drives 2, 3 and 4 are stopped, which occurs when both photoeyes 99 and 101 are clear at substantially the same time, the System Start-Up routine will be used to continue operation of the system.

Figure 14:
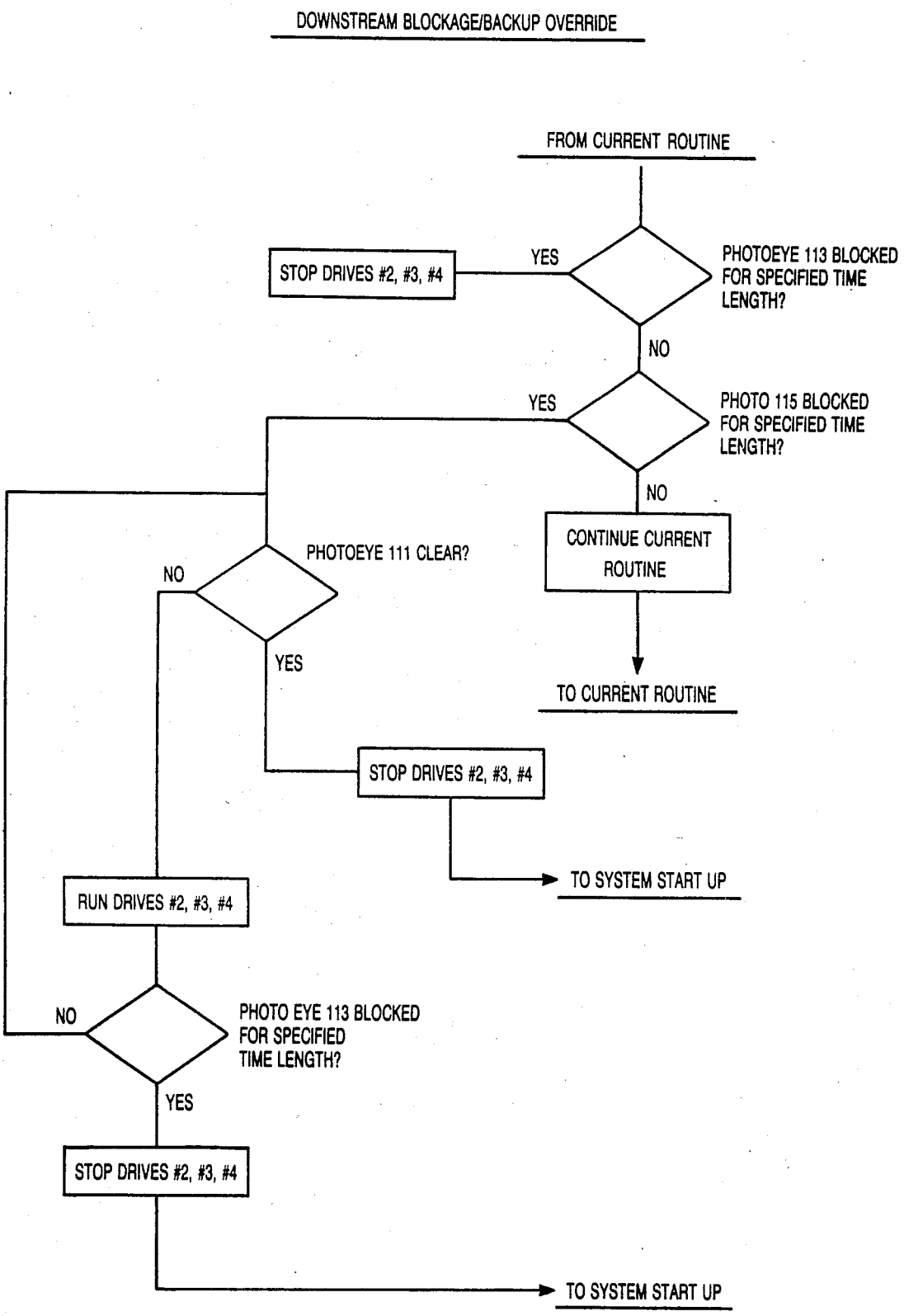

Referring to FIG. 14, the control algorithm includes a sub-routine for detecting downstream blockage on third conveyor track 63. This sub-routine is run prior to all decision points in the System Start-Up, Normal Operation and Pause for No/Low Containers modes, as described with reference to FIGS. 11, 12 and 13. If photoeye 113 is blocked for a specified length of time (i.e., the normal length of time for a case of containers 15 to pass photoeye 113 plus a certain percentage of that time) Drives 2, 3 and 4 are stopped. If photoeye 113 is not blocked, but photoeye 115 is blocked for the aforementioned specified length of time, photoeye 111 will be checked to determine if containers 15 are in the packing position on ramp 53. If photoeye 111 is blocked, Drives 2, 3 and 4 will be run until either photoeye 113 is blocked for the specified length of time or until photoeye 111 is clear, indicating that there are not containers 15 in the packing position on ramp 53. When Drives 2, 3 and 4 are stopped, the program will branch to the System Start-Up mode, as depicted in FIG. 11.

The system and method according to the present invention is suitable for use in connection with returnable or non-returnable low depth trays and is able to pack containers either in pre-formed six-packs, eight-packs and twelve-packs or in a loose state into transport trays in a continuous motion without having to unnecessarily slow down or interrupt the movement of the containers and trays. The system and method of the present invention further provide substantial cost savings by providing a tray packer which is able to pack 70–80 cases per minute using a simpler, less expensive technique. The approximate cost of the automated system according to the present invention is on the order of $40,000–$70,000. The fact that the system can be used in conjunction with certain returnable trays offers an additional substantial cost advantage over prior art systems, such as the tray former loader and the ski packer, which require new trays to be used during each operation. The automated system according to the present invention also has substantial advantages over such prior art systems as the vertical drop packer and the ski packer by providing substantially faster operation and tray packing speeds without unnecessary slowdowns or interruptions in operation.

Various embodiments of the invention have now been described in detail. Since it is obvious that many changes in and additions to the above-described preferred embodiment may be made without departing from the spirit and scope of the invention, the invention is not to be limited to said details, except as set forth in the appended claims.

What is claimed is:

1. A system for packing containers into corresponding transport trays comprising:

first conveyor means for transporting said containers along a first track;

means for dividing said containers into selected groups, the number of containers in each group corresponding to the number of containers to be packed into each tray;

second conveyor means for transporting said trays along a second conveyor track, a portion of said second conveyor track being inclined with respect to said first conveyor track so that said first and second tracks converge at a predetermined location;

ramp means having an upstream end and a downstream end, said ramp means being pivotally attached to said first track at a selected position on said ramp means between said upstream end and said downstream end to define a first portion between said upstream end and said selected position and a second portion between said selected position and said downstream end, said ramp means for being moved upwardly to an inclined position with respect to said first track when said second portion of said ramp means is in contact with the leading or the trailing edge of one of said trays and for being returned to a substantially horizontal position with respect to said first track when said second portion of said ramp means is not in contact with the leading or the trailing edge of one of said trays, said first portion of said ramp means for engaging said first track to prevent said second portion of said ramp means from being pivoted below said horizontal position; and means for controlling the movements of the containers on the first track and the trays on the second track so that each group of containers is packed into the corresponding tray in succession from the leading to the trailing edge of the tray while the tray is being moved upwardly along the inclined portion of the second track.

2. The system according to claim 1 wherein said ramp means is attached to the first track adjacent to said predetermined location, said selected position being upstream of the position on said ramp means at which the leading edge of each tray first contacts the ramp means.

3. The system according to claim 1 wherein said first track is comprised of a movable portion and a stationary portion, said stationary portion being downstream of said movable portion, said ramp means being attached to the downstream end of said stationary portion.

4. The system according to claim 1 further including means for selectively raising and lowering said ramp means in response to the movement of said trays beneath said ramp means, said ramp means being raised to said inclined position when either the leading or trailing edge of the tray is in contact with the ramp means and being returned to the horizontal position when neither the leading nor trailing edge of a tray is in contact with the ramp means.

5. The system according to claim 1 wherein said containers are substantially cylindrical containers having a substantially greater height than diameter.

6. The system according to claim 1 wherein said tray has a bottom member for journally supporting the containers in the tray and a plurality of upright walls surrounding said bottom member to define an open mouth enclosure, the downstream end of said ramp means being substantially in contact with the bottom member of the corresponding tray when containers are being packed into said tray, to facilitate the transition of the containers from the ramp means to the tray.

7. A system for packing containers into corresponding transport trays, comprising:

first conveyor means for transporting said containers along a first track, said first track having a moveable portion and a stationary portion, said stationary portion being downstream of said moveable portion, said first conveyor means further including first, second and third sprocket-driven chain means arranged to form respective first, second and third continuous vertical loops, a portion of said first chain means defining said moveable portion of said first track and second and third chain means for moving said groups of containers along said stationary portion of said first track;

means for dividing said containers into selected groups, the number of containers in each group corresponding to the number of containers to be packed into each tray;

second conveyor means for transporting said trays along a second conveyor track, a portion of said second conveyor track being inclined with respect to said first conveyor track so that said first and second tracks converge at a predetermined location;

ramp means pivotally attached to said first track at the downstream end of said stationary portion and adjacent to said predetermined location, said ramp means for being moved upwardly to an inclined position with respect to said first track when said ramp means is in engagement with the leading or the trailing edge of one of said trays and for being returned to a substantially horizontal position with respect to said first track when said ramp means is not in engagement with the leading or the trailing edge of one of said trays; and means for controlling the movements of the containers on the first track and of the trays on the second track so that each group of containers is packed into the corresponding tray in succession from the leading edge to the trailing edge of the tray while the tray is being moved upwardly along the inclined portion of the second track.

8. The system according to claim 2 wherein each of said second and third chain means includes a plurality of projecting members extending perpendicularly outward therefrom for engaging said groups of containers to move said containers along the stationary portion of said first track.

9. The system according to claim 8 wherein said dividing means is comprised of a plurality of elongated dividers mounted at selected positions on fourth and fifth sprocket-driven chain means, said dividers for being interposed between selected containers on the movable track for dividing the containers into discrete groups of a predetermined number of containers in each group, adjacent ones of said dividers being separated by a distance approximately equal to the length of a container group, as measured longitudinally along the movable track.

10. The system according to claim 9 wherein each group of containers is arranged in a substantially rectangular pattern of rows and columns on said first track, each row being oriented laterally across the first track and each column being oriented longitudinally along the first track, all of the containers in a particular row being loaded substantially simultaneously into the corresponding tray and each row of containers being loaded in succession so that the tray is filled in sequence from the leading edge to the trailing edge thereof.

11. The system according to claim 10 wherein said projection members engage the trailing row of containers in the respective groups of containers to move each group of containers past the end of said ramp means and into the corresponding tray while said tray is moving on the inclined portion of said second track, said containers being maintained in a substantially vertical orientation so that the respective bottom surfaces of the containers are oriented at an acute angle with respect to the bottom surface of the tray.

12. The system according to claim 11 wherein selected portions of said second and third chain means slope gradually downward so that said projection members engage the respective trailing rows of containers sufficiently low on the respective surfaces of said containers to maintain the stability of the containers.

13. The system according to claim 9 further including first drive means for driving said first chain means, second drive means for driving said second conveyor track, third drive means for driving said second and third chain means and fourth drive means for driving said fourth and fifth chain means.

14. The system according to claim 13 wherein said fourth drive means is mechanically slaved to said third drive means so as to be operable in conjunction therewith.

15. The system according to claim 9 wherein selected portions of said fourth and fifth chain means slope gradually downward to facilitate the positioning of said dividers between selected ones of said containers.

16. The system according to claim 11 further including third conveyor means for transporting the packed tray to a predetermined destination, said third conveyor means including a substantially horizontal third track on which said loaded tray is moved, said containers being oriented substantially orthogonally with respect to the bottom surface of said tray so that the respective bottom surfaces of said containers are substantially in contact with the bottom surface of said tray when said packed tray is on said third track.

17. The system according to claim 8 wherein corresponding ones of said projection members on said second and third chain means are coupled together by means of laterally extending roller members, said roller members for contacting the trailing containers in each group of containers to move the corresponding group of containers along the first track at substantially the same speed as the projection members.

18. A system for packing containers into corresponding transport trays, comprising:

first conveyor means for transporting said containers along a first track;

means for dividing said containers into selected groups, the number of containers in each group corresponding to the number of containers to be packed into each tray;

second conveyor means for transporting said trays along a second conveyor track, a portion of said second conveyor track being inclined with respect to said first conveyor track so that said first and second tracks converge at a predetermined location;

ramp means pivotally attached to said first track adjacent to said predetermined location;

means for selectively raising and lowering said ramp means in response to the movement of said trays beneath said ramp means, said ramp means being raised to an inclined position when either the leading or trailing edge of a tray is in contact with the ramp means and being returned to a horizontal position when neither the leading nor trailing edge of the tray is in contact with the ramp means, said means for raising and lowering the ramp means being comprised of a cam which is moveable along said first track and a stationary spring-loaded push rod follower coupled to said ramp means upstream of the position at which said ramp means is pivotally attached to said first track for engaging said cam as said cam is moved along said first track, said cam for exerting downward pressure on said push rod follower to tilt said ramp means upward when said cam is in engagement with said push rod follower, said push rod follower being moved upwardly by spring bias when said push rod follower is not in engagement with said cam, to return said ramp means to the horizontal position; and means for controlling the movements of the containers on the first track and the trays on the second track so that each group of containers is packed into the corresponding tray in succession from the leading edge to the trailing edge of the tray while the tray is being moved upwardly along the inclined portion of the second track.

19. A system for packing containers into corresponding transport trays, comprising:

first conveyor means for transporting said containers along a first track;

means for dividing said containers into selected groups, the number of containers in each group corresponding to the number of containers to be packed into each tray;

second conveyor means for transporting said trays along a second conveyor track, a portion of said second conveyor track being inclined with respect to said first conveyor track so that said first and second tracks converge at a predetermined location;

ramp means pivotally attached to said first track adjacent to said predetermined location;

means for selectively raising and lowering said ramp means in response to the movement of the trays beneath said ramp means, said ramp means being raised to an inclined position when either the leading or trailing edge of a tray is in contact with the ramp means and being returned to a horizontal position when neither the leading nor the trailing edge of the tray is in contact with the ramp means, said means for raising and lowering the ramp means being comprised of roller means mounted on said second track and extending upwardly therefrom above each tray, said roller means being positioned in front of the leading edge and behind the trailing edge of each tray for lifting the ramp means while said ramp means is in contact with either the leading or trailing edge of each tray; and means for controlling the movements of the containers on the first track and the trays on the second track so that each group of containers is packed into the corresponding tray in succession from the leading edge to the trailing edge of the tray while the tray is being moved upwardly along the inclined portion of the second track.

20. The system according to claim 19 wherein said roller means is comprised of first and second rollers mounted on opposite sides of said second track, said inclined portion of said second track being comprised of first and second parallel sprocket-driven chains, which are driven in respective continuous vertical loop, and a stationary portion downstream of said chains, said stationary portion having first and second elongated slots therein for receiving said respective first and second rollers as said first and second rollers rotate around respective sprockets at the respective downstream ends of said first and second chains.

21. A system for packing containers into corresponding transport trays, comprising:

first conveyor means for transporting said containers along a first track;

means for dividing said containers into selected groups, the number of containers in each group corresponding to the number of containers to be packed into each tray;

second conveyor means for transporting said trays along a second conveyor track, a portion of said second conveyor track being inclined with respect to said first conveyor track so that said first and second tracks converge at a predetermined location;

ramp means pivotally attached to said first track adjacent to said predetermined location, said ramp means for being moved upwardly to an inclined position with respect to said first track when said ramp means is in engagement with the leading or the trailing edge of a tray and for being returned to a substantially horizontal position with respect to said first track when said ramp means is not in engagement with the leading or trailing edge of the tray; and means for controlling the movements of the containers on the first track and the trays on the second track so that each group of containers is packed into the corresponding tray in succession from the leading edge to the trailing edge of the tray while the tray is being moved upwardly along said inclined portion of the second track, said control means comprising:

first detector means for generating a first electrical signal when a container is present at a first selected position on said first track substantially upstream from said ramp means;

second detector means for generating a second electrical signal when a container is present at a selected position on said ramp means;

third detector means for generating a third electrical signal when a tray is at a selected position on said second track in proximity to said ramp means;

fourth detector means for generating a fourth electrical signal when said ramp means is in the substantially horizontal position with respect to said first track;

means for activating said first conveyor means to transport containers on the first track in response to the presence of said first electrical signal and for deactivating said first conveyor means in response to the absence of said first and third electrical signals;

means for activating said second conveyor means to transport trays on said second track in response to either the absence of said third electrical signal when the first conveyor means is deactivated or the presence of said second electrical signal when said first conveyor means is activated and for de-activating said second conveyor means in response to either said third electrical signal when said first conveyor means is deactivated or to the presence of said third and fourth electrical signals and the absence of said second electrical signal when the first conveyor means is activated.

22. The system according to claim 21 wherein said first detector means is comprised of first and second photoelectric detectors positioned upstream of said dividing means for detecting the presence of containers on said first track upstream of said dividing means, said second detector being positioned downstream from said first detector at a distance less than or equal to the length of a container group, as measured longitudinally along the first track, said first and second conveyor means being deactivated when no container is detected by either the first or second detectors and said second electrical signal is absent.

23. The system according to claim 21 wherein said first track is comprised of a movable portion and a stationary portion downstream of said movable portion and said first conveyor means includes first, second and third sprocket-driven chain means arranged to form respective first, second and third continuous vertical loops, a portion of said first chain means defining said movable portion of said first track and said second and third chain means for moving said groups of containers along said stationary portion of said first track.

24. The system according to claim 23 wherein said dividing means includes fourth and fifth sprocket-driven chain means and said system further includes first drive means for driving said first chain means, second drive means for driving said second conveyor track, third drive means for driving said second and third chain means and fourth drive means for driving said fourth and fifth chain means.

25. The system according to claim 24 wherein said control means further includes fifth detector means for generating a fifth electrical signal when said dividing means is properly positioned with respect to said containers, said fourth drive means being activated in response to the absence of said fifth electrical signal to position said dividing means as desired with respect to said containers and being deactivated in response to the presence of said fifth electrical signal when said first drive means is deactivated.

26. The system according to claim 25 wherein said control means further includes sixth detector means positioned downstream from said first detector means for generating a sixth electrical signal when containers are present between adjacent ones of said dividing means, said first drive means being activated in response to said sixth electrical signal when said fourth drive means is deactivated.

27. The system according to claim 26 wherein said control system further includes seventh detector means positioned downstream from said first detector means and in proximity to said ramp means on the upstream side thereof, for generating a seventh electrical signal when a container is present at the position of the seventh detector means, and first, second, third and fourth drive means being deactivated in response to said seventh electrical signal when said third electrical signal is not generated.

28. The system according to claim 27 wherein said system further includes third conveyor means for transporting the packed tray to a predetermined destination, said third conveyor means including a third track located downstream of said first and second conveyor tracks, and eighth detector means for detecting the presence of packed trays at selected positions on the third track and for generating an eighth electrical signal when the presence of a packed tray is detected for a predetermined length of time, thereby indicating a blockage downstream on the third track, said first, second, third and fourth drive means being deactivated in response to said eighth electrical signal.

29. The system according to claim 28 wherein said eighth detector means is comprised of third and fourth photoelectric detectors, said fourth detector being positioned downstream of said third detector on said third track, said eighth electrical signal being generated when either said third detector is blocked by the presence of a packed tray for the predetermined length of the time or when said fourth detector is blocked by the presence of a packed tray for the predetermined length of time and said second electrical signal is absent.

30. The system according to claim 29 wherein said control means includes a digital computer having memory means in which a predetermined set of instructions is programmed, said computer for controlling the operation of said first, second, third and fourth drive means in response to the electrical signals generated by said eight detector means in accordance with said predetermined set of instructions.

31. The system according to claim 30 wherein said computer includes input means for receiving said electrical signals from said detector means and reducing the voltage thereof for processing, means for processing said electrical input signals in accordance with the predetermined set of instructions and generating control signals for operating the first, second, third and fourth drive means and output means for increasing the voltage of said output signals to operate said first, second, third and fourth drive means in accordance with said control signals.

32. A method for packing containers into a transport tray, comprising the steps of:

providing an apparatus having a first and second conveyor tracks, said second conveyor track having a portion which is inclined with respect to the first conveyor track so that said first and second conveyor tracks converge at a predetermined location, and ramp means pivotally attached to said first conveyor track adjacent to said predetermined location;

dividing said containers into selected groups, the number of containers in each group corresponding to the number of containers to be loaded into each tray;

placing said containers on said first track and said trays on said second track; and controlling the movements of said containers on said first track and said trays on said second track so that the individual containers in each group are loaded into the corresponding tray in accordance from the leading edge to the trailing edge of the tray while said tray is being moved along the inclined portion of said second track by means of the following substeps:

detecting the presence of a container at a selected position on said first track substantially upstream from said ramp means and generating a first electrical signal indicative thereof;

detecting the presence of a container at a selected position on said ramp means and generating a second electrical signal indicative thereof;

detecting the presence of a tray at a selected position on said second track in proximity to said ramp means and generating a third electrical signal indicative thereof;

detecting the position of said ramp means and generating a fourth electrical signal when said ramp means is in the substantially horizontal position with respect to said first track;

activating said first conveyor track to transport containers on the first track in response to the presence of said first electrical signal and deactivating said first conveyor track in response to the absence of said first and third electrical signals; and activating said second conveyor track to transport trays on the second track in response to either the absence of said third electrical signal when the first conveyor track is deactivated or the presence of said electrical signal when the first conveyor track is activated and deactivating said second conveyor track in response to either said third electrical signal when said first conveyor track is deactivated or to the presence of said third and fourth electrical signals and the absence of said second electrical signal when the first conveyor track is activated.

33. The method according to claim 32 further including the sub-step of detecting the position of said dividing means and generating a fifth electrical signal when said dividing means is properly positioned with respect to said containers on said first track and moving said dividing means in response to the absence of said fifth electrical signal to position said dividing means as desired with respect to said containers.

34. The method according to claim 33 further including the sub-step of detecting the presence of containers between adjacent ones of said dividing means and generating a sixth electrical signal indicative thereof and activating the first conveyor means to transport containers on said first track in response to said sixth electrical signal when said dividing means is stationary.

35. The method according to claim 34 further including the sub-step of detecting the presence of containers in proximity to said ramp means on the upstream side thereof and genrating a seventh electrical signal when a container is present and deactivating the first and second conveyor means in response to said seventh electrical signal in the absence of said third electrical signal.

36. The method according to claim 35 wherein said tray packing system further includes third conveyor means for transporting a packed tray to a predetermined destination, said third conveyor means including a third track located downstream of the first and second tracks, and said method further includes the sub-step of detecting the presence of packed trays at a selected position on the third track and generating an eighth electrical signal when a packed tray is detected at said selected position for a predetermined length of time, thereby indicating a blockage downstream on the third track, and deactivating the first and second conveyor means in response to said eighth electrical signal.

37. The method according to claim 32 wherein the step of dividing said containers into selected groups includes the sub-step of arranging the containers in a substantially rectangular pattern of rows and columns on said first track, each row being oriented laterally across the first track and each column being oriented longitudinally along the first track, so that all of the containers in a particular row are loaded substantially simultaneously into the corresponding tray and each row of containers is loaded in succession to fill the tray in sequence from the leading edge to the trailing edge thereof.

* * * * *